US008393106B2

(12) United States Patent
Cauley et al.

(10) Patent No.: US 8,393,106 B2
(45) **Date of Patent: *Mar. 12, 2013**

(54) SHOOTING RESTS WITH ADJUSTABLE HEIGHT FOR SUPPORTING FIREARMS

(75) Inventors: Dennis Cauley, Boonville, MO (US); Adam Birk, Lohman, MO (US); Tim Kinney, Columbia, MO (US); Michael E. Cottrell, Columbia, MO (US); Yan-Jiang Zhou, Columbia, MO (US); Russell A. Potterfield, Columbia, MO (US); Jim Gianladis, Columbia, MO (US); Robert Joseph Zara, Rocheport, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/183,212

(22) Filed: Jul. 14, 2011

(65) Prior Publication Data

US 2012/0144647 A1 Jun. 14, 2012

Related U.S. Application Data

(63) Continuation of application No. 12/276,229, filed on Nov. 21, 2008, now Pat. No. 7,997,021.

(51) Int. Cl.
*F41A 23/02* (2006.01)
*F41A 23/16* (2006.01)

(52) U.S. Cl. ..... 42/94

(58) Field of Classification Search ..... 42/94; 89/37.04; 73/167

See application file for complete search history.

(56) References Cited

U.S. PATENT DOCUMENTS 197,397 A 11/1877 O'Neil
387,411 A 8/1888 Gisel
(Continued)

FOREIGN PATENT DOCUMENTS

DE 838872 5/1952
EP 0624455 11/1994
(Continued)

OTHER PUBLICATIONS

1shop2.com *Hoppe's Gunsmith's Fully Adjustable Bench Vise*; 3 pages. The date on which the Hoppe's Gunsmith's Fully Adjustable Bench Vise was first on sale is not known, but is believed to be circa 2004.

(Continued)

*Primary Examiner* — Bret Hayes
(74) *Attorney, Agent, or Firm* — Perkins Coie LLP

(57) ABSTRACT

Shooting rests having elevation adjustment assemblies are disclosed herein. One embodiment of the disclosure, for example, is directed to a shooting rest for supporting a firearm having a buttstock spaced apart from a forestock. The shooting rest includes a first base portion carrying a first support for supporting the buttstock and a second base portion coupled to the first base portion and carrying a second support for supporting the forestock. The second base portion includes a body having an opening extending therethrough, and a height adjustment member slidably positioned in the opening. The height adjustment member has a non-circular cross-sectional shape in a plane that is generally transverse to a longitudinal axis of the height adjustment member. The height adjustment member is attached to the second support and configured to adjust a height of the second support. The second base portion includes a biasing member contacting the height adjustment member to at least partially inhibit movement of the height adjustment member through the opening.

20 Claims, 8 Drawing Sheets

U.S. PATENT DOCUMENTS

| | | | |
|---|---|---|---|
| 399,604 | A | 3/1889 | Dufner et al. |
| 499,315 | A | 6/1893 | Borchardt |
| 568,543 | A | 9/1896 | Parks |
| 668,219 | A | 2/1901 | Rock |
| 691,912 | A | 1/1902 | McClean |
| 718,865 | A | 1/1903 | Northcraft |
| 778,865 | A | 1/1905 | Hyenga |
| 789,909 | A | 5/1905 | Herold |
| 1,033,624 | A | 7/1912 | Schmeisser |
| 1,061,577 | A | 5/1913 | Whitney |
| 1,088,362 | A | 2/1914 | Perkins |
| 1,089,307 | A | 3/1914 | Benet et al. |
| 1,121,945 | A | 12/1914 | Smith |
| 1,145,585 | A | 7/1915 | Hebard |
| 1,175,692 | A | 3/1916 | Boicourt |
| 1,187,325 | A | 6/1916 | Ivey |
| 1,195,777 | A | 8/1916 | Burtin |
| 1,250,215 | A | 12/1917 | Panos |
| 1,256,255 | A | 2/1918 | Porter |
| 1,295,688 | A | 2/1919 | Butler |
| 1,367,353 | A | 2/1921 | Craig |
| 1,457,407 | A | 6/1923 | Stokes |
| 1,488,647 | A | 4/1924 | Quinn |
| 1,491,604 | A | 4/1924 | Fuller |
| 1,639,722 | A | 8/1927 | Whitney |
| 1,693,289 | A | 11/1928 | Warren |
| 1,736,244 | A | 11/1929 | Baker |
| 1,928,871 | A | 10/1931 | Swebilius |
| 1,902,040 | A | 3/1933 | Meyer |
| 1,907,181 | A | 5/1933 | Fey |
| 1,927,876 | A | 9/1933 | Meyer |
| 2,066,218 | A | 12/1936 | Morgan |
| 2,079,510 | A | 5/1937 | King et al. |
| 2,090,930 | A | 8/1937 | Chubb |
| 2,100,514 | A | 11/1937 | Miller |
| 2,121,982 | A | 6/1938 | Pugsley |
| 2,125,353 | A | 8/1938 | Mattson |
| 2,216,766 | A | 10/1940 | Cook |
| 2,232,743 | A | 2/1941 | Swenson |
| 2,297,993 | A | 10/1942 | Tratsch |
| 2,331,372 | A | 10/1943 | Buchanan |
| 2,427,365 | A | 3/1944 | Meister |
| 2,455,644 | A | 6/1944 | Barnes |
| 2,378,545 | A | 6/1945 | Fraser et al. |
| D147,305 | S | 8/1947 | Sloan |
| 2,432,519 | A | 12/1947 | Garand |
| 2,451,266 | A | 12/1948 | Whittemore |
| 2,476,078 | A | 7/1949 | Banks |
| 2,479,354 | A | 8/1949 | Hanson |
| 2,483,089 | A | 9/1949 | Ferguson |
| 2,484,801 | A | 10/1949 | Anderson |
| 2,508,951 | A | 5/1950 | Kazimier |
| 2,510,380 | A | 6/1950 | Clifford |
| 2,517,268 | A | 8/1950 | Wilson |
| 2,582,140 | A | 1/1952 | Leek |
| 2,638,676 | A | 5/1953 | Callahan |
| 2,677,207 | A | 5/1954 | Stewart |
| 2,701,930 | A | 2/1955 | Dolan |
| 2,729,975 | A | 1/1956 | Hawthorne |
| 2,731,829 | A | 1/1956 | Wigington et al. |
| 2,740,530 | A | 4/1956 | Ponder |
| 2,753,642 | A | 7/1956 | Sullivan |
| 2,774,090 | A | 12/1956 | Allinson |
| 2,774,563 | A | 12/1956 | Pribis |
| 2,795,881 | A | 6/1957 | Bellows |
| 2,813,376 | A | 11/1957 | Middlemark |
| 2,817,233 | A | 12/1957 | Dower et al. |
| 2,821,117 | A | 1/1958 | Hultgren |
| 3,013,289 | A | 3/1958 | Sasena |
| 2,847,909 | A | 8/1958 | Kester |
| 2,867,931 | A | 1/1959 | Schreiber |
| 2,874,707 | A | 2/1959 | Koppel |
| 2,877,689 | A | 3/1959 | Pribis |
| 2,894,347 | A | 7/1959 | Woodcock |
| 2,924,881 | A | 2/1960 | Gee |
| 2,924,904 | A | 2/1960 | Amsler |
| 2,924,914 | A | 2/1960 | Garwood |
| 2,975,540 | A | 3/1961 | Lewis |
| 2,999,788 | A | 9/1961 | Morgan |
| 3,011,283 | A | 12/1961 | Lunn et al. |
| 3,012,350 | A | 12/1961 | Wold |
| 3,023,527 | A | 3/1962 | Leek et al. |
| 3,024,653 | A | 3/1962 | Broadway |
| 3,041,938 | A | 7/1962 | Seabrook |
| 3,055,655 | A | 9/1962 | Chelf |
| 3,060,612 | A | 10/1962 | Brown et al. |
| 3,064,976 | A | 11/1962 | Kuhn |
| 3,107,642 | A | 10/1963 | Lakin |
| 3,112,567 | A | 12/1963 | Flanagan |
| 3,125,929 | A | 3/1964 | Peasley |
| 3,128,668 | A | 4/1964 | Dicken |
| 3,137,957 | A | 6/1964 | Ingalls |
| 3,163,420 | A | 12/1964 | Braun |
| 3,175,456 | A | 3/1965 | Goodsell |
| 3,183,617 | A | 5/1965 | Ruger et al. |
| 3,205,518 | A | 9/1965 | Romaine |
| 3,206,885 | A | 9/1965 | Dye |
| 3,225,656 | A | 12/1965 | Flaherty et al. |
| D203,680 | S | 2/1966 | Allison |
| 3,240,103 | A | 3/1966 | Lamont |
| 3,259,986 | A | 7/1966 | Carr |
| 3,283,425 | A | 11/1966 | Boyd |
| 3,283,643 | A | 11/1966 | Mittelsteadt |
| 3,291,317 | A | 12/1966 | Bowen |
| 3,292,293 | A | 12/1966 | Chiasera et al. |
| 3,320,848 | A | 5/1967 | Ponsness |
| 3,323,246 | A | 6/1967 | Loffler |
| 3,327,422 | A | 6/1967 | Harris |
| 3,330,561 | A | 7/1967 | Kandel |
| 3,343,411 | A | 9/1967 | Lee |
| 3,353,827 | A | 11/1967 | Dun, Jr |
| 3,358,504 | A | 12/1967 | Freebairn |
| 3,370,852 | A | 2/1968 | Kandel |
| 3,406,969 | A | 10/1968 | Tisdell et al. |
| 3,423,092 | A | 1/1969 | Kandel |
| D215,311 | S | 9/1969 | Born |
| 3,473,673 | A | 10/1969 | Porter |
| 3,486,752 | A | 12/1969 | Colvin |
| 3,499,525 | A | 3/1970 | Kanter |
| 3,510,951 | A | 5/1970 | Dow |
| 3,513,604 | A | 5/1970 | Matsunaga et al. |
| 3,536,160 | A | 10/1970 | Brewer |
| 3,550,941 | A | 12/1970 | Spiro et al. |
| 3,556,666 | A | 1/1971 | Lichenstern |
| D220,154 | S | 3/1971 | Irelan |
| 3,572,712 | A | 3/1971 | Vick |
| 3,580,127 | A | 5/1971 | Lee |
| 3,583,556 | A | 6/1971 | Wagner |
| 3,584,820 | A | 6/1971 | Butcher, Sr. |
| 3,587,193 | A | 6/1971 | Lewis |
| 3,608,225 | A | 9/1971 | Manuel |
| 3,609,902 | A | 10/1971 | Casull |
| 3,646,704 | A | 3/1972 | Ellsworth |
| 3,648,909 | A | 3/1972 | Wisecarver |
| 3,680,266 | A | 8/1972 | Shiplov |
| 3,680,354 | A | 8/1972 | Phillips, Jr. |
| 3,711,955 | A | 1/1973 | Holt |
| 3,711,984 | A | 1/1973 | Dyer et al. |
| 3,736,243 | A | 5/1973 | Duggan |
| 3,738,101 | A | 6/1973 | Simon-Vermot |
| 3,739,515 | A | 6/1973 | Koon, Jr. |
| 3,743,088 | A | 7/1973 | Henkin |
| 3,744,292 | A | 7/1973 | Michelson |
| 3,745,875 | A | 7/1973 | Kennedy et al. |
| 3,748,950 | A | 7/1973 | Huntington |
| 3,764,219 | A | 10/1973 | Collins |
| 3,769,758 | A | 11/1973 | McDonald |
| 3,771,176 | A | 11/1973 | Herman |
| 3,804,238 | A | 4/1974 | Howard |
| 3,813,816 | A | 6/1974 | Funk |
| 3,815,270 | A | 6/1974 | Pachmayr |
| 3,826,559 | A | 7/1974 | Berliner et al. |
| 3,827,172 | A | 8/1974 | Howe |
| 3,842,527 | A | 10/1974 | Low |
| D233,853 | S | 12/1974 | Ferrara |
| 3,876,078 | A | 4/1975 | Gomes et al. |
| 3,877,178 | A | 4/1975 | Campanelli |

3,878,939 A 4/1975 Wilcox
3,885,357 A 5/1975 Hoyt
3,893,266 A 7/1975 Anderson et al.
3,895,803 A 7/1975 Loe
3,899,175 A 8/1975 Loe
3,899,797 A 8/1975 Gunst
D237,106 S 10/1975 Baljet et al.
3,913,746 A 10/1975 Burton
3,914,879 A 10/1975 Taylor, III et al.
3,935,657 A 2/1976 Wade
3,947,988 A 4/1976 Besaw
3,949,987 A 4/1976 Candor
3,961,436 A 6/1976 Hagen et al.
3,964,613 A 6/1976 Anderson, Jr.
3,979,849 A 9/1976 Haskins
4,007,554 A 2/1977 Helmstadter
4,012,860 A 3/1977 Auger
4,021,971 A 5/1977 McFadden
4,026,057 A 5/1977 Cady
4,027,781 A 6/1977 Covert
4,042,242 A 8/1977 Nicholls et al.
4,054,288 A 10/1977 Perrine, Sr.
4,055,016 A 10/1977 Katsenes
4,072,313 A 2/1978 Murso et al.
4,076,247 A 2/1978 Kim et al.
4,090,606 A 5/1978 Dawson
4,120,108 A 10/1978 Vickers et al.
4,120,276 A 10/1978 Curran
4,122,623 A 10/1978 Stice
4,143,491 A 3/1979 Blanc
4,177,608 A 12/1979 Balz
4,188,855 A 2/1980 Alberts
4,203,600 A 5/1980 Brown
4,206,573 A 6/1980 Hayward
4,222,305 A 9/1980 Lee
4,223,588 A 9/1980 Simpson
4,233,748 A 11/1980 Ford et al.
D257,687 S 12/1980 Bechtel
4,266,748 A 5/1981 Dalton
4,266,780 A 5/1981 McQuary
4,282,671 A 8/1981 Wood et al.
D260,650 S 9/1981 Alviti
D261,794 S 11/1981 Bechtel
4,301,625 A 11/1981 Rampe
4,312,146 A 1/1982 Koon, Jr.
4,332,185 A 6/1982 Hargrove
4,333,385 A 6/1982 Culver
4,338,726 A 7/1982 Swailes
4,340,370 A 7/1982 Marshall et al.
4,345,398 A 8/1982 Pickett
4,346,530 A 8/1982 Stewart et al.
4,359,833 A 11/1982 Pachmayr et al.
4,361,989 A 12/1982 Ohno
4,385,464 A 5/1983 Casull
4,385,545 A 5/1983 Duer
4,391,058 A 7/1983 Casull
4,392,321 A 7/1983 Bosworth
4,407,379 A 10/1983 Pryor et al.
4,409,751 A 10/1983 Goda et al.
4,409,826 A 10/1983 Wenger
4,426,085 A 1/1984 Dixon
4,438,913 A 3/1984 Hylia
4,449,314 A 5/1984 Sorensen
4,462,598 A 7/1984 Chalin et al.
4,477,082 A 10/1984 McKenzie et al.
4,480,411 A 11/1984 Balz et al.
4,506,466 A 3/1985 Hall
4,508,508 A 4/1985 Theodore
4,512,101 A 4/1985 Waterman, Jr.
4,522,102 A 6/1985 Pickens
4,526,084 A 7/1985 David et al.
4,540,182 A 9/1985 Clement
4,542,677 A 9/1985 Lee
4,548,392 A 10/1985 Rickling
4,558,531 A 12/1985 Kilby
D283,561 S 4/1986 Geist et al.
4,601,124 A 7/1986 Brown, Jr.
4,608,762 A 9/1986 Varner
4,621,563 A 11/1986 Poiencot
4,625,620 A 12/1986 Harris
4,632,008 A 12/1986 Horner
4,644,987 A 2/1987 Kiang et al.
4,648,191 A 3/1987 Goff et al.
4,653,210 A 3/1987 Poff, Jr.
4,671,364 A 6/1987 Fink et al.
4,674,216 A 6/1987 Ruger et al.
4,695,060 A 9/1987 Pilgrim
4,696,356 A 9/1987 Ellion et al.
4,702,029 A 10/1987 DeVaul et al.
4,715,476 A 12/1987 France
4,716,673 A 1/1988 Williams et al.
4,721,205 A 1/1988 Burt et al.
4,723,472 A 2/1988 Lee
4,729,186 A 3/1988 Rieger
4,732,394 A 3/1988 Stein et al.
4,736,843 A 4/1988 Leonard
4,739,996 A 4/1988 Vedder
4,751,963 A 6/1988 Bui et al.
D297,855 S 9/1988 Ruger et al.
4,776,471 A 10/1988 Elkins
4,790,079 A 12/1988 Meyers
4,790,096 A 12/1988 Gibson et al.
4,799,324 A 1/1989 Nodo
4,807,381 A 2/1989 Southard
4,807,888 A 2/1989 Pidde et al.
4,815,593 A 3/1989 Brown
4,819,359 A 4/1989 Bassett
4,821,422 A 4/1989 Porter
4,821,443 A 4/1989 Bianco et al.
4,823,673 A 4/1989 Downing
4,824,086 A 4/1989 Rickling et al.
4,841,839 A 6/1989 Stuart
4,850,151 A 7/1989 Ditscherlein
4,854,066 A 8/1989 Canterbury
4,862,567 A 9/1989 Beebe
D304,223 S 10/1989 Ruger et al.
4,873,777 A 10/1989 Southard
4,890,406 A 1/1990 French
4,890,847 A 1/1990 Cartee et al.
4,896,446 A 1/1990 Gregory
D306,234 S 2/1990 Ferstl et al.
4,903,425 A 2/1990 Harris
4,910,904 A 3/1990 Rose
4,918,825 A 4/1990 Lesh et al.
4,921,256 A 5/1990 Gearhart
4,923,402 A 5/1990 Marshall et al.
4,924,616 A 5/1990 Bell et al.
4,937,965 A 7/1990 Narvaez
D310,302 S 9/1990 Southard
4,967,497 A 11/1990 Yakscoe
4,971,208 A 11/1990 Reinfried, Jr. et al.
4,972,619 A 11/1990 Eckert
4,979,752 A 12/1990 Fosseen
D313,886 S 1/1991 Southard
4,987,694 A 1/1991 Lombardo
4,998,367 A 3/1991 Leibowitz
4,998,944 A 3/1991 Lund
5,005,657 A 4/1991 Ellion et al.
5,009,021 A 4/1991 Nelson
5,014,793 A 5/1991 Germanton et al.
5,031,348 A 7/1991 Carey
5,050,330 A 9/1991 Pilgrim et al.
5,058,302 A 10/1991 Minneman
5,060,410 A 10/1991 Mueller
5,063,679 A 11/1991 Schwandt
5,067,268 A 11/1991 Ransom
5,070,636 A 12/1991 Mueller
5,074,188 A 12/1991 Harris
5,081,783 A 1/1992 Jarvis
5,117,850 A 6/1992 Money
5,123,194 A 6/1992 Mason
5,125,389 A 6/1992 Paff
5,143,340 A 9/1992 Wood et al.
5,149,900 A 9/1992 Buck
5,173,563 A 12/1992 Gray
5,180,874 A 1/1993 Troncoso
5,185,927 A 2/1993 Rivers
5,186,468 A 2/1993 Davies

| | | | |
|---|---|---|---|
| 5,188,371 | A | 2/1993 | Edwards |
| 5,194,678 | A | 3/1993 | Kramer |
| D335,896 | S | 5/1993 | Evenson |
| 5,211,404 | A | 5/1993 | Grant |
| 5,221,806 | A | 6/1993 | Chaney et al. |
| 5,222,306 | A | 6/1993 | Neumann |
| 5,228,887 | A | 7/1993 | Mayer et al. |
| 5,232,227 | A | 8/1993 | Bateman |
| 5,233,779 | A | 8/1993 | Shaw |
| 5,235,764 | A | 8/1993 | Perazzi et al. |
| 5,237,778 | A | 8/1993 | Baer |
| 5,240,258 | A | 8/1993 | Bateman |
| 5,247,758 | A | 9/1993 | Mason |
| 5,271,175 | A | 12/1993 | West, III |
| 5,275,890 | A | 1/1994 | Wolf et al. |
| 5,287,643 | A | 2/1994 | Arizpe-Gilmore |
| 5,311,693 | A | 5/1994 | Underwood |
| 5,315,781 | A | 5/1994 | Beisner |
| 5,316,579 | A | 5/1994 | McMillan et al. |
| 5,317,826 | A | 6/1994 | Underwood |
| 5,320,217 | A | 6/1994 | Lenarz |
| 5,320,223 | A | 6/1994 | Allen |
| 5,328,029 | A | 7/1994 | Chow et al. |
| 5,332,185 | A | 7/1994 | Walker, III |
| 5,333,829 | A | 8/1994 | Bell et al. |
| 5,335,578 | A | 8/1994 | Lorden et al. |
| 5,337,505 | A | 8/1994 | Brown et al. |
| 5,344,012 | A | 9/1994 | Matthews |
| 5,347,740 | A | 9/1994 | Rather et al. |
| 5,351,428 | A | 10/1994 | Graham |
| 5,358,254 | A | 10/1994 | Yeh et al. |
| 5,361,505 | A | 11/1994 | Faughn |
| 5,367,232 | A | 11/1994 | Netherton et al. |
| 5,370,240 | A | 12/1994 | Hand |
| 5,375,337 | A | 12/1994 | Butler |
| 5,375,377 | A | 12/1994 | Kenton |
| 5,377,437 | A | 1/1995 | Underwood |
| 5,392,553 | A | 2/1995 | Carey |
| 5,394,983 | A | 3/1995 | Latulippe et al. |
| 5,402,595 | A | 4/1995 | Tamllos |
| 5,406,733 | A | 4/1995 | Tarlton et al. |
| 5,410,833 | A | 5/1995 | Patterson |
| 5,414,949 | A | 5/1995 | Peebles |
| D359,392 | S | 6/1995 | Bellington |
| 5,421,115 | A | 6/1995 | McKay |
| 5,433,010 | A | 7/1995 | Bell |
| 5,433,451 | A | 7/1995 | De Vries |
| 5,435,223 | A | 7/1995 | Blodgett et al. |
| 5,442,860 | A | 8/1995 | Palmer |
| D362,116 | S | 9/1995 | Bellington et al. |
| 5,446,987 | A | 9/1995 | Lee et al. |
| D364,080 | S | 11/1995 | Weyrauch |
| 5,481,817 | A | 1/1996 | Parker |
| 5,482,241 | A | 1/1996 | Oglesby |
| 5,486,135 | A | 1/1996 | Arpaio |
| 5,490,302 | A | 2/1996 | Dion |
| 5,491,921 | A | 2/1996 | Allen |
| 5,497,557 | A | 3/1996 | Martinsson et al. |
| 5,497,575 | A | 3/1996 | Fried |
| 5,501,467 | A | 3/1996 | Kandel |
| D369,904 | S | 5/1996 | Taylor |
| 5,525,314 | A | 6/1996 | Hurson |
| 5,540,329 | A | 7/1996 | Vogeley |
| 5,545,855 | A | 8/1996 | Stanfield et al. |
| 5,562,208 | A | 10/1996 | Hasler et al. |
| D375,538 | S | 11/1996 | Minneman |
| 5,570,513 | A | 11/1996 | Peterson |
| 5,580,063 | A | 12/1996 | Edwards |
| 5,588,242 | A | 12/1996 | Hughes |
| 5,600,913 | A | 2/1997 | Minneman |
| 5,617,666 | A | 4/1997 | Scott |
| 5,622,344 | A | 4/1997 | Gracie |
| 5,628,135 | A | 5/1997 | Cady |
| D380,116 | S | 6/1997 | Minneman |
| 5,640,944 | A | 6/1997 | Minneman |
| 5,644,862 | A | 7/1997 | Folmer |
| 5,649,465 | A | 7/1997 | Beebe |
| 5,651,207 | A | 7/1997 | Knight |
| 5,653,625 | A | 8/1997 | Pierce et al. |
| 5,661,919 | A | 9/1997 | Pryor |
| 5,662,516 | A | 9/1997 | You |
| 5,666,757 | A | 9/1997 | Helmstadler |
| D387,123 | S | 12/1997 | Hughes et al. |
| 5,703,317 | A | 12/1997 | Levilly et al. |
| 5,711,102 | A | 1/1998 | Plaster et al. |
| 5,711,103 | A | 1/1998 | Keng |
| 5,715,625 | A | 2/1998 | West |
| D391,616 | S | 3/1998 | Plybon |
| 5,723,183 | A | 3/1998 | Williams et al. |
| 5,723,806 | A | 3/1998 | Odom |
| 5,725,096 | A | 3/1998 | Winnard |
| 5,737,865 | A | 4/1998 | Brandl et al. |
| 5,740,625 | A | 4/1998 | Jenkins |
| 5,743,395 | A | 4/1998 | Backer |
| 5,758,447 | A | 6/1998 | Venetz |
| 5,758,933 | A | 6/1998 | Clendening |
| 5,761,954 | A | 6/1998 | Dvorak |
| 5,778,589 | A | 7/1998 | Teague |
| 5,779,527 | A | 7/1998 | Maebashi |
| 5,791,499 | A | 8/1998 | Zebbedies |
| 5,811,720 | A | 9/1998 | Quinnell et al. |
| 5,813,131 | A | 9/1998 | Werre |
| 5,815,974 | A | 10/1998 | Keng |
| 5,833,308 | A | 11/1998 | Strong, III et al. |
| D403,176 | S | 12/1998 | Harper |
| 5,845,774 | A | 12/1998 | Hausknecht |
| 5,857,279 | A | 1/1999 | de Oliveira Masina |
| 5,875,580 | A | 3/1999 | Hill et al. |
| 5,878,504 | A | 3/1999 | Harms |
| 5,884,966 | A | 3/1999 | Hill et al. |
| 5,899,329 | A | 5/1999 | Hu et al. |
| 5,907,919 | A | 6/1999 | Keeney |
| 5,913,422 | A | 6/1999 | Cote |
| 5,913,668 | A | 6/1999 | Messer |
| 5,924,694 | A | 7/1999 | Kent |
| 5,930,932 | A | 8/1999 | Peterson |
| 5,933,997 | A | 8/1999 | Barrett |
| 5,933,999 | A | 8/1999 | McClure et al. |
| 5,959,613 | A | 9/1999 | Rosenberg et al. |
| 5,970,642 | A | 10/1999 | Martin |
| 5,974,719 | A | 11/1999 | Simonek |
| 6,019,375 | A | 2/2000 | West, Jr. |
| 6,021,891 | A | 2/2000 | Anderson |
| 6,032,796 | A | 3/2000 | Hopper |
| 6,042,080 | A | 3/2000 | Shepherd et al. |
| 6,044,747 | A | 4/2000 | Felts |
| 6,058,641 | A | 5/2000 | Vecqueray |
| 6,073,381 | A | 6/2000 | Farrar et al. |
| 6,086,375 | A | 7/2000 | Legros |
| 6,092,662 | A | 7/2000 | Frederick |
| 6,110,020 | A | 8/2000 | Rolfi |
| 6,121,556 | A | 9/2000 | Cole |
| 6,237,462 | B1 | 5/2001 | Hawkes et al. |
| 6,254,100 | B1 | 7/2001 | Rinehart |
| 6,260,463 | B1 | 7/2001 | Brand et al. |
| 6,269,578 | B1 | 8/2001 | Callegari |
| 6,283,428 | B1 | 9/2001 | Maples et al. |
| 6,289,622 | B1 | 9/2001 | Desch et al. |
| 6,293,041 | B2 | 9/2001 | Weaver |
| 6,294,759 | B1 | 9/2001 | Dunn, Jr. |
| 6,305,117 | B1 | 10/2001 | Hales, Sr. |
| 6,309,476 | B1 | 10/2001 | Ravenscroft et al. |
| 6,338,218 | B1 | 1/2002 | Hegler |
| 6,390,294 | B1 | 5/2002 | Fiore, Jr. et al. |
| 6,397,720 | B1 | 6/2002 | Fox et al. |
| 6,439,515 | B1 | 8/2002 | Powers |
| 6,439,530 | B1 | 8/2002 | Schoenfish et al. |
| 6,517,133 | B2 | 2/2003 | Seegmiller et al. |
| D471,248 | S | 3/2003 | Jacobs |
| 6,526,687 | B1 | 3/2003 | Looney |
| D473,376 | S | 4/2003 | Abate |
| 6,546,662 | B1 | 4/2003 | Chong |
| 6,557,855 | B2 | 5/2003 | Wu |
| 6,574,899 | B1 | 6/2003 | Mostello |
| 6,575,469 | B2 | 6/2003 | Love |
| 6,643,973 | B1 | 11/2003 | Smith |
| 6,663,298 | B2 | 12/2003 | Haney |
| 6,688,031 | B2 | 2/2004 | Steele |

| | | | | |
|---|---|---|---|---|
| 6,733,375 | B2 | 5/2004 | Hoffman | |
| 6,736,400 | B1 | 5/2004 | Cesternino | |
| 6,813,855 | B2 | 11/2004 | Pinkley | |
| 6,814,654 | B2 | 11/2004 | Rolfi | |
| 6,854,975 | B2 | 2/2005 | Ranzinger | |
| 6,860,054 | B1 | 3/2005 | Mosher | |
| 6,862,833 | B1 | 3/2005 | Gurtner | |
| 6,871,440 | B2 | 3/2005 | Highfill et al. | |
| 6,877,266 | B1 | 4/2005 | Brownlee | |
| 6,883,263 | B1 | 4/2005 | Carrow | |
| 6,931,777 | B1 | 8/2005 | Krien | |
| 6,953,114 | B2 | 10/2005 | Wang et al. | |
| D513,055 | S | 12/2005 | Lahti | |
| 6,978,569 | B2 | 12/2005 | Williamson et al. | |
| D519,183 | S | 4/2006 | Minneman | |
| 7,032,494 | B2 | 4/2006 | Wygant | |
| D521,100 | S | 5/2006 | Morrow | |
| 7,062,979 | B2 | 6/2006 | Day et al. | |
| D524,541 | S | 7/2006 | Cauley | |
| 7,086,192 | B2 | 8/2006 | Deros | |
| 7,104,398 | B1 | 9/2006 | Wisecarver | |
| 7,134,663 | B1 | 11/2006 | Lowe et al. | |
| 7,143,986 | B1 | 12/2006 | Austin et al. | |
| 7,152,355 | B2 | 12/2006 | Fitzpatrick et al. | |
| 7,152,358 | B1 | 12/2006 | LeAnna et al. | |
| 7,159,711 | B1 | 1/2007 | Gardner | |
| 7,165,750 | B2 | 1/2007 | McCuskey et al. | |
| 7,188,445 | B2 | 3/2007 | Lehman | |
| D540,904 | S | 4/2007 | Werner | |
| 7,201,376 | B2 | 4/2007 | Kuosa | |
| 7,207,567 | B1 | 4/2007 | Brown | |
| D543,604 | S | 5/2007 | Minneman | |
| 7,213,494 | B2 | 5/2007 | James | |
| 7,225,050 | B2 | 5/2007 | Sutula, Jr. | |
| D553,219 | S | 10/2007 | Potterfield | |
| 7,281,346 | B1 | 10/2007 | Cook et al. | |
| D567,895 | S | 4/2008 | Cauley | |
| 7,356,960 | B1 | 4/2008 | Knitt | |
| 7,356,961 | B2 | 4/2008 | Williams | |
| 7,357,250 | B2 | 4/2008 | Hagemann | |
| 7,363,740 | B2 | 4/2008 | Kincel | |
| 7,367,451 | B2 | 5/2008 | Pendergraph et al. | |
| 7,401,431 | B2 | 7/2008 | Pierce et al. | |
| 7,410,053 | B2 | 8/2008 | Bowen et al. | |
| D576,245 | S | 9/2008 | Potterfield | |
| 7,421,815 | B1 | 9/2008 | Moody et al. | |
| 7,426,800 | B2 | 9/2008 | Pierce et al. | |
| 7,536,820 | B2 | 5/2009 | Wade et al. | |
| 7,549,247 | B1 | 6/2009 | Reese | |
| 7,584,690 | B2 | 9/2009 | Cauley | |
| D605,246 | S | 12/2009 | Hobbs | |
| 7,631,455 | B2 | 12/2009 | Keng et al. | |
| 7,654,498 | B1 | 2/2010 | Beltz | |
| 7,665,241 | B2 | 2/2010 | Oz | |
| 7,676,977 | B1 | 3/2010 | Cahill et al. | |
| 7,681,886 | B2 | 3/2010 | Morrow et al. | |
| 7,694,973 | B1 | 4/2010 | Hofmeister et al. | |
| 7,726,478 | B2 | 6/2010 | Potterfield et al. | |
| 7,730,824 | B1 | 6/2010 | Black | |
| 7,774,972 | B2 | 8/2010 | Potterfield et al. | |
| 7,779,572 | B2 | 8/2010 | Potterfield et al. | |
| 7,845,267 | B2 | 12/2010 | Potterfield et al. | |
| 7,946,071 | B2 | 5/2011 | Cauley et al. | |
| 7,954,272 | B2 | 6/2011 | Potterfield et al. | |
| 7,997,021 | B2 * | 8/2011 | Cauley et al. | 42/94 |
| 8,011,129 | B2 | 9/2011 | Cauley | |
| 2002/0113372 | A1 | 8/2002 | Love | |
| 2002/0195752 | A1 | 12/2002 | Yang | |
| 2003/0079395 | A1 | 5/2003 | Chong | |
| 2003/0177685 | A1 | 9/2003 | Pinkley | |
| 2003/0234205 | A1 | 12/2003 | McGuyer | |
| 2004/0020097 | A1 | 2/2004 | Deros et al. | |
| 2004/0112777 | A1 | 6/2004 | Huang | |
| 2004/0134113 | A1 | 7/2004 | Deros et al. | |
| 2005/0000141 | A1 | 1/2005 | Cauley et al. | |
| 2005/0011101 | A1 | 1/2005 | Gooder | |
| 2005/0115137 | A1 | 6/2005 | Minneman | |
| 2005/0178039 | A1 | 8/2005 | Flores | |
| 2005/0183319 | A1 | 8/2005 | Franks | |
| 2005/0188597 | A1 | 9/2005 | Keng et al. | |
| 2005/0242250 | A1 | 11/2005 | Keng et al. | |
| 2006/0063653 | A1 | 3/2006 | Wickens et al. | |
| 2006/0070900 | A1 | 4/2006 | Brunson | |
| 2006/0174532 | A1 | 8/2006 | Popikow | |
| 2006/0175213 | A1 | 8/2006 | Hurt et al. | |
| 2006/0218840 | A1 | 10/2006 | Cauley | |
| 2006/0236584 | A1 | 10/2006 | Williams | |
| 2006/0248774 | A1 | 11/2006 | Pierce et al. | |
| 2006/0248775 | A1 | 11/2006 | Wade et al. | |
| 2006/0254111 | A1 | 11/2006 | Giauque et al. | |
| 2006/0277811 | A1 | 12/2006 | Peterson | |
| 2006/0278797 | A1 | 12/2006 | Keng et al. | |
| 2007/0029733 | A1 | 2/2007 | Anderson | |
| 2007/0046760 | A1 | 3/2007 | Zara | |
| 2007/0051028 | A1 | 3/2007 | Stordal | |
| 2007/0068379 | A1 | 3/2007 | Sween et al. | |
| 2007/0068835 | A1 | 3/2007 | Buie et al. | |
| 2007/0074439 | A2 | 4/2007 | Cauley et al. | |
| 2007/0074440 | A2 | 4/2007 | Cauley | |
| 2007/0094911 | A1 | 5/2007 | Rush et al. | |
| 2007/0113460 | A1 | 5/2007 | Potterfield et al. | |
| 2007/0175077 | A1 | 8/2007 | Laney et al. | |
| 2007/0256346 | A1 | 11/2007 | Potterfield et al. | |
| 2007/0262529 | A1 | 11/2007 | Gamez et al. | |
| 2007/0266610 | A1 | 11/2007 | Coffield | |
| 2007/0294929 | A1 | 12/2007 | Potterfield et al. | |
| 2007/0294930 | A1 | 12/2007 | Mays | |
| 2007/0295197 | A1 | 12/2007 | Potterfield | |
| 2008/0023379 | A1 | 1/2008 | Potterfield et al. | |
| 2008/0034636 | A1 | 2/2008 | Potterfield et al. | |
| 2008/0041700 | A1 | 2/2008 | Potterfield et al. | |
| 2008/0047189 | A1 | 2/2008 | Potterfield et al. | |
| 2008/0054570 | A1 | 3/2008 | Potterfield et al. | |
| 2008/0061509 | A1 | 3/2008 | Potterfield | |
| 2008/0127815 | A1 | 6/2008 | Yale et al. | |
| 2008/0128002 | A1 | 6/2008 | Jeffs | |
| 2008/0156671 | A1 | 7/2008 | Jansson | |
| 2008/0163534 | A1 | 7/2008 | Lombardi | |
| 2008/0174071 | A1 | 7/2008 | Potterfield et al. | |
| 2008/0263928 | A1 | 10/2008 | Potterfield | |
| 2009/0020447 | A1 | 1/2009 | Potterfield et al. | |
| 2009/0049731 | A1 | 2/2009 | Seuk | |
| 2009/0126250 | A1 | 5/2009 | Keng | |
| 2010/0032905 | A1 | 2/2010 | Morrow et al. | |
| 2010/0102178 | A1 | 4/2010 | Smith et al. | |
| 2010/0116163 | A1 | 5/2010 | Zara | |
| 2010/0126055 | A1 | 5/2010 | Potterfield et al. | |
| 2010/0138032 | A1 | 6/2010 | Potterfield | |
| 2010/0236125 | A1 | 9/2010 | Morrow et al. | |
| 2010/0270201 | A1 | 10/2010 | Cauley et al. | |
| 2011/0024985 | A1 | 2/2011 | Potterfield et al. | |
| 2011/0036214 | A1 | 2/2011 | Potterfield | |
| 2011/0036236 | A1 | 2/2011 | Potterfield et al. | |
| 2011/0079524 | A1 | 4/2011 | Potterfield | |
| 2011/0167705 | A1 * | 7/2011 | Cauley et al. | 42/94 |
| 2011/0192069 | A1 * | 8/2011 | Potterfield et al. | 42/94 |
| 2011/0225788 | A1 | 9/2011 | Potterfield | |
| 2012/0011760 | A1 * | 1/2012 | Cauley | 42/94 |
| 2012/0085012 | A1 | 4/2012 | Potterfield et al. | |

FOREIGN PATENT DOCUMENTS

| | | |
|---|---|---|
| GB | 475080 | 11/1937 |

OTHER PUBLICATIONS

AcuSport, Outdoor Sporting Products, 3 pgs., undated.

*American Rifleman: What to do about recoil*, LookSmart, http://www.findarticles.com/p/articels/mi_qa3623/is_199907/ai_n886159/print, pp. 1-4 [Internet accessed on Jan. 4, 2006].

Auto-Flo Lyman Turbo 1200 Tumbler, 2 pages [product photos].

Battenfeld Technologies, Inc., "Gun Vise," Tipton Gun Cleaning Supplies, Battenfeld Technologies, Inc. 2004 Catalog, p. 32, Product No. 782-731, 2 pgs.

Battenfeld Technologies, Inc., "Steady Rest Portable Shooting Rest," 1 page [Internet accessed Jan. 25, 2006].

Big Boy Gun Toys, "Shooting Rest," http://www.bigboyguntoys.com/shootingrest.htm, 1 page [Internet accessed on Jul. 18, 2008].

Birchwood Casey 2005 Catalog, 28 pages.
Birchwood Casey 2006 Catalog. The date of availability of this catalog is unknown, but is believed to be in Jan. 2006 or later. pp. 5-17 (color copy attached).
Birchwood Casey, "Dirty Bird@Splattering Targets," http://www.birchwoodcasey.com/sport/target_index.asp?categoryID=4&subcat=22 , pp. 1-4, internet accessed Jan. 16, 2006.
Birchwood Casey, "Shoot•N•C® Targets," http://www.birchwoodcasey.com/sport/target_index.asp?categoryID=4&subcat=8, pp. 1-8, internet accessed Jan. 16, 2006.
Birchwood Casey, "Targets Spots®." http://www.birchwoodcasey.com/sport_index.asp?categoryID=4&subcat=12 , pp. 1-2, internet accessed Jun. 16, 2006.
Birchwood Casey, "World of Targets®" http://www.birchwoodcasey.com/sport/target_index.asp?categoryID=4&subcat=13 , pp. 1-4, internet accessed Jan. 16, 2006.
Boyt Harness Company, Product Catalog, http://www.boytharness.com/catalog/index.php?cPath=22, 2 pages [Internet accessed on Jul. 21, 2008].
Brass Cleaning Kits, http://www.berrysmfg.com/81.php, 1 page [Internet accessed Apr. 24, 2007].
Brownells Inc., Brownells Magna—Tip Screwdriver, Brownells Catalog No. 54 for 2001-2002, 2001, p. 151.
Brownells Inc., Brownells Magna—Tip Super-Sets, Brownells Catalog No. 54 for 2001-2002, 2001, p. 153.
Brownells Inc., Catalog No. 41 1988-1989 3 pages (8909).
Brownells Inc., Catalog No. 47 1994-1995 2 pages (8909).
Brownells Inc., Catalog No. 57. For 2004-2005. 2 pages.
Brownells Inc., Sight Base Cutters, Faxed Dec. 17, 2003, 1 page.
B-Square , Pro Gunsmith Screwdriver Set, B-Square Mounts Tools Accessories Product Catalog, p. 23, date unknown.
Cabela's "Master Catalog Fall 2003: Late-Season Edition" Cover page and p. 416. 2 pages.
Cabela's Hunting Fishing and Outdoor Gear Master Catalog, Fall 2002, Edition II, Minimizer Rifle Rest, Item No. SC-22-4332, p. 492.
*Cabela's Rotary Media Separator*, http://www.cabelas/en/templates/links/link.jsp;jsessionid=QYVQMKM0P0P5.., 2 pages [Internet accessed Apr. 24, 2007].
Cabela's, "BenchBuddy® Gun Rest," http://www.cabelas.com/cabelas/en/templates/links/link.jsp?id=0005819221954a&type=product&cmCat=, © 1996-2008, 2 pages [Internet accessed on Aug. 6, 2008].
Cabela's, "Elite Rifle Rest," http://www.cabelas.com/cabelas/en/templates/links/link.jsp?id=0005817227855a&type=product&cmCat=, © 1996-2008, 2 pages [Internet accessed on Aug. 6, 2008].
Cabela's, "HySkore Sighting System and Cleaning Vise," the date on which the HySkore Sighting System and Cleaning Vise was first on sale is not known, but is believed to be circa Jan. 2005. However, a prototype of this product may have been shown to.
Cabela's, "Hyskore® Dangerous Game™ Machine Rest," http://www.cabelas.com/cabelas/en/templates/links/link.jsp?id=0044091228566a&type=product&cmCat=, © 1996-2008, 2 pages [Internet accessed on Aug. 6, 2008].
Cabela's, "Hyskore® Ultimate Sighting Rest," http://www.cabelas.com/cabelas/en/templates/links/link.jsp?id=0024152226083a&type=product&cmCat=, © 1996-2008, 2 pages [Internet accessed on Aug. 6, 2008].
Cabela's, "Nitro Shoulder Shield Rest," http://www.cabelas.com/cabelas/en/templates/links/link.jsp?id=0040862228231a&type=product&cmCat=, © 1996-2008, 2 pages [Internet accessed on Aug. 6, 2008].
Cabela's, "Premier Rifle Rest," http://www.cabelas.com/cabelas/en/templates/links/link.jsp?id=0020904227856a&type=product&cmCat=.., © 1996-2008, 2 pages [Internet accessed on Aug. 6, 2008].
Cabela's, "Secure Bench Rest," http://www.cabelas.com/cabelas/en/templates/links/link.jsp;sessionid=4F0LP0OW2HMRLLAQBBISCOF.., © 1996-2008, 2 pages [Internet accessed on Aug. 6, 2008].
Cabela's, "Sharp Shooter Auto Magnum Rifle Rest," http://www.cabelas.com/cabelas/en/templates/links/link.jsp?id=0054107229088a&type=product&cmCat=, © 1996-2008, 2 pages [Internet accessed on Aug. 6, 2008].
Cabela's, "Sharp Shooter Rifle Rest," http://www.cabelas.com/cabelas/en/templates/links/link.jsp?id=0005816222738a&type=product&cmCat=, © 1996-2008, 2 pages [Internet accessed on Aug. 6, 2008].
Cabela's, "Shooting Benches & Portable Rifle Shooting Bench Rest," http://www.cabelas.com/ssubcat-1/cat20793.shtml, 3 pages [Internet accessed Jul. 18, 2008].
Cabela's, "Sure Shot Shooting Vise/Rest," http://www.cabelas.com/cabelas/en/templates/product/standard-item.jsp?id=00348272277. . . , © 1996-2008, 2 pages [Internet accessed on Jul. 15, 2008].
Caldwell Insta-View™ 4 Targets.
Caldwell Shooting Supplies, 2006 Catalog, pp. 18, 5, 12, 14 and 15.
Caldwell Shooting Supplies, Targets & Target Accessories, Instra-View™ Targets, 1 page.
Caldwells Insta-View 4 Targets, 1 page [product photo].
Californiavarmintcallers.com—Forum, http://californiavarmintcallers.com/community/modules/newbb/viewtopic.php?topic_id=10&forum=9&PHPSESSID=074ed8c7. . . , pp. 1-4, accessed Jan. 16, 2006.
Canadian Camo, "Gun Rest," http://media5.magma.ca/www.canadiancamo.com/catalog/product_info.php?products_id=. . . , 2 pages [Internet accessed on Feb. 13, 2006].
Carmichael, J., "Reloading for Accuracy," Lyman Reloading Handbook, 46th Edition, pp. 68-77.
Champion Targets, "Next Generation Paper Targets," http://www.championtarget.com/products/targets/next_generation_targets.aspx , pp. 1-3, [internet accessed Jan. 16, 2006].
Champion Traps & Target, 2005 Product Catalog , 12 pages.
Chastain, R., "Load 'em Up!" About.com: Hunting/Shooting, http://hunting.about.com/od/reloadinginfo/a/aaloademup_2htm , 6 pages [Internet accessed on Aug. 31, 2007].
*Cleaning Cradles: Sinclaire Cleaning Cradles* p. 21, The date on which the Sinclair Folding Cleaning Cradle was first on sale is not known, but is believed to be circa 2004.
Cork Industries, Inc., "Double Bumping Coating Applications," Cork Tech TalkNews, Feb. 1997, 2 pages.
CTK Precision, "P3 Ultimate Shooting Rest," http://www.ctkprecision.com/index.asp?PageAction=VIEWPROD&ProdOID=2, 3 pages [Internet accessed on Jul. 18, 2008].
CTK Precision, All Products, http://www.ctkprecision.com/index.asp?PageAction=VIEWCATS&Cate.., 3 pages [Internet accessed on Jul. 22, 2008].
*CTK® P3 Ultimate Shooting Rest*; Amazon.com, Sports & Outdoors, http://www.amazon.com/CTK%C2%AE-P3-Ultimate-Shooting-Rest/dp/. . . , 1 page [Internet accessed on Jul. 22, 2008].
CV-500, 3 pages [product photos].
*Decker Rifle Vise*, 1 page. The date on which the Decker Rifle Vise was first on sale is not known but is believed to be circa 2004.
Device manufactured by Shooter's Ridge, A division of ATK, and available at least by late 2005, 1 page.
Dillon Precision CV-500 Cartridge Case Vibratory Cleaner, 6 pages [product photos].
E. Arthur Brown Company, "A Shooting Rest that Really Works..," http://www.eabco.com/TargetShooting01.html, © 2007-2008, 1 page [Internet accessed Jul. 18, 2008].
Edgewood Shooting Bags Catalog, http://www.edgebag.com/catalog.php, 7 pages [Internet accessed on Feb. 14, 2006].
Eforcity Magnetic Screwdriver Set w/15 bits Great for Cellphones, Computers Includes: T6, TORX, Security TORX, Philips, Slotted, Spanner, Tri-Wing, Bent Pry Tool, Round AWL, Reset Pin for Game Boy Advance, Nintendo Wii, DS lite, NDS, Apple TV , Amazon.com.
Ellett Brothers, Rests & Gun Vises, pp. 621-622, date unknown.
European Search Report; European Patent Application No. 07863915.0; Filed: Nov. 5, 2007; Applicant: Battenfeld Technologies, Inc.; Mailed on Oct. 14, 2010.
Final Office Action; U.S. Appl. No. 10/865,595; Mailed on Apr. 3, 2007, 10 pages.
Final Office Action; U.S. Appl. No. 11/206,430; Mailed on Apr. 1, 2010, 14 pages.
Final Office Action; U.S. Appl. No. 11/206,430; Mailed on May 12, 2011, 14 pages.

Final Office Action; U.S. Appl. No. 11/206,430; Mailed on Oct. 29, 2007, 13 pages.
Final Office Action; U.S. Appl. No. 11/206,430; Mailed on Nov. 24, 2008, 12 pages.
Final Office Action; U.S. Appl. No. 11/271,100; Mailed on Sep. 22, 2008, 8 pages.
Final Office Action; U.S. Appl. No. 11/339,863; Mailed on Mar. 10, 2009, 6 pages.
Final Office Action; U.S. Appl. No. 11/431,956; Mailed on Nov. 27, 2009, 13 pages.
Final Office Action; U.S. Appl. No. 11/505,784; Mailed on Dec. 19, 2008, 10 pages.
Final Office Action; U.S. Appl. No. 11/507,683; Mailed on Apr. 6, 2010, 7 pages.
Final Office Action; U.S. Appl. No. 11/607,550; Mailed on Nov. 27, 2009, 14 pages.
Final Office Action; U.S. Appl. No. 11/679,100: Mailed on Feb. 18, 2011, 11 pages.
Final Office Action; U.S. Appl. No. 11/679,100; Mailed on Aug. 3, 2009, 9 pages.
Final Office Action; U.S. Appl. No. 11/679,136; Mailed on Apr. 10, 2009, 22 pages.
Final Office Action; U.S. Appl. No. 11/679,832; Mailed on Jun. 8, 2010, 12 pages.
Final Office Action; U.S. Appl. No. 11/801,341; Mailed on Sep. 30, 2009, 6 pages.
Final Office Action; U.S. Appl. No. 11/844,980; Mailed on May 25, 2010, 6 pages.
Final Office Action; U.S. Appl. No. 11/853,763; Mailed on Jul. 13, 2009, 7 pages.
Final Office Action; U.S. Appl. No. 12/177,032; Mailed on Oct. 5, 2010, 11 pages.
Final Office Action; U.S. Appl. No. 12/476,041; Mailed on Jul. 20, 2010, 7 pages.
Final Office Action; U.S. Appl. No. 12/848,649; Mailed on Jan. 18, 2012, 6 pages.
Grafix Plastics, http://grafixplastic.com/plastic_film_g.asp?gclid=CK-5-_7gnY4CFRVNhgodjFhfSQ , 29 pages [Internet accessed on Aug. 30, 2007].
Gun Rest—Shooting Rest—Rifle Rests, http://www.jexploreproducts.com/gunrests-shootingrests.htm, 6 pages [Internet accessed Jul. 18, 2008].
Harris, J. et al., The Art and Science of Annealing, http://www.6mmbr.com/annealing.html, © 2005, 13 pages [Internet accessed on Aug. 13, 2007].
Hyskore, "Rest—Dangerous Game Machine Rest," Hyskore Rest, Professional firearm rests, http://www.hyskore.com/rests.htm, 2 pages [Internet accessed Jul. 21, 2008].
Hyskore: Professional Shooting Accessories. "Dangerous Game Machine Rest," Accessed Feb. 22, 2006 www.hyskore.com, 10 pages.
Hyskore: Professional Shooting Accessories. "Hydraulic Trigger Release." Accessed Feb. 22, 2006. www.hyskore.com 7 pages.
International Search Report and Written Opinion; International Patent Application No. PCT/US07/76440; Filed: Aug. 21, 2007; Applicant: Battenfeld Technologies, Inc.; Mailed on Sep. 30, 2008.
International Search Report and Written Opinion; International Patent Application No. PCT/US07/76587; Filed: Aug. 22, 2007; Applicant: Battenfeld Technologies, Inc.; Mailed on Jul. 30, 2008.
International Search Report and Written Opinion; International Patent Application No. PCT/US07/83674; Filed: Nov. 5, 2007; Applicant: Battenfeld Technologies, Inc.; Mailed on Jun. 11, 2008.
Joe's, "Shooter's Ridge Steady Point Shooting Rest," http://www.joessport.com/product/index.jsp?productID=3155005&cp=726872&parentpag.., Item No. 3155005, 1 page [Internet accessed Jul. 17, 2008].
Lahti Company Brochure, "Rock Solid Hold," Rifle Evaluator, http://www.lathicompany.com/Forms/EvaluatorBrochure2.jpg, 2 pages [Internet accessed Jan. 16, 2006].
Lahti Company Brochure, "Rifle Evaluator: No Pain, No Fear, No Flinching, No Body Movement," www.lahticompany.com, 2 pages, undated.
Lee Precision, Inc., "Load-All," 1 page.
Lee Precision, Inc., "The World's Fastest Handloading Press . . . Lee Progressive 1000," 1985 Catalog, pp. 1-15.
Lohman Sight Vise, 4 pages product photographs, the date on which the Lohman Site Vise was first on sale is not known, but is believed to be circa 2004.
Lyman Hornady Case Tumbler, 2 pages [product photos].
Lyman Turbo 600 Tumbler, 3 pages [product photos].
Lyman Turbo Pro 1200 Tumber, 2 pages [product photos].
Lyman, "A History of Lyman Metallic Reloading," Reloading Handbook, 46th Edition, pp. 10-31.
Lyman, "Introduction to Reloading," Reloading Handbook, 46th Edition, pp. 170-203.
MacksPW.com, "Desert Mountain Bench Master Rifle Rest," http://www.macksqw.com/Item--i-DESBM1, © 2004-2008, 1 page [Internet accessed Jul. 22, 2008].
Midway USA, Chapman 27-Piece Deluxe Screwdriver Set, Master Catalog and Reference Guide #2, 2004, p. 440.
Midway USA, Pachmayr Professional Screwdriver Set, Master Catalog and Reference Guide #2, 2004, p. 448.
Midway USA, Wheeler Engineering Space-Saver Gunsmithing Screwdriver Set, Master Catalog and Reference Guide #2, 2004, p. 453.
Midway USA. "Tipton Range Box with Ultimate Rifle, Handgun Cleaning Kit (No Solvents)," http://www.midwayusa.com/rewriteaproduct/135086, The date on which the Tipton Range Box was first on sale is not known, but is believed to be circa 2004, 2 pages.
MidwayUSA, "ADG Rifle Shooting Rest," http://www.midwayusa.com/eproductpage.exe/showproduct?saleitemid=992071&t=11082005, 2005, 3 pages [Internet accessed on Aug. 6, 2008].
MidwayUSA, "Caldwell Full Length Fire Control Shooting Rest," http://www.midwayusa.com/eproductpage.exe/showproduct?saleitemid=683866&t=11082005, 2005, 3 pages [Internet accessed on Aug. 6, 2008].
MidwayUSA, "Caldwell Lead Sled DFT Rifle Shooting Rest," http://www.midwayusa.com/eproductpage.exe/showproduct?saleitemid=149023&t=11082005, 2005, 6 pages [Internet accessed on Aug. 6, 2008].
MidwayUSA, "Caldwell Lead Sled Rifle Shooting Rest," http://www.midwayusa.com/eproductpage.exe/showproduct?saleitemid=152664&t=11082005, 2005, 8 pages [Internet accessed on Aug. 6, 2008].
MidwayUSA, "Caldwell Steady Rest NXT Rifle Shooting Rest," http://www.midwayusa.com/eproductpage.exe/showproduct?saleitemid=838651&t=11082005, 2005, 4 pages [Internet accessed on Aug. 6, 2008].
MidwayUSA, "Caldwell Zero-Max Rifle Shooting Rest," http://www.midwayusa.com/eproductpage.exe/showproduct?saleitemid=726222&t=11082005, 2005, 3 pages [Internet accessed on Aug. 6, 2008].
MidwayUSA, "CTK Precision P3 Ultimate Shooting Rest," http://www.midwayusa.com/eproductpage.exe/showproduct?saleitemid=114699&t=11082005, 2005, 2 pages [Internet accessed on Aug. 6, 2008].
MidwayUSA, "Hyskore® dangerous Game Rifle Shooting Rest," http://www.midwayusa.com/eproductpage.exe/showproduct?saleitemid=729197&t=11082005, 2005, 3 pages [Internet accessed on Aug. 6, 2008].
MidwayUSA, "Hyskore® Precision Gas Dampened Recoil Reducing Rifle Shooting Rest," http://www.midwayusa.com/eproductpage.exe/showproduct?saleitemid=838848&t=11082005, 2005, 4 pages [Internet accessed on Aug. 6, 2008].
MidwayUSA, "Hyskore® Swivel Varmint Rifle Shooting Rest," http://www.midwayusa.com/eproductpage.exe/showproduct?saleitemid=587606&t=11082005, 2005, 3 pages [Internet accessed on Aug. 6, 2008].
MidwayUSA, "Shooters Ridge Steady Point Rifle Shooting Rest and Vise," http://www.midwayusa.com/eproductpage.exe/showproduct?saleitemid=341095&t=11082005, 2005, 4 pages [Internet accessed on Aug. 6, 2008].

MidwayUSA, "Shooters Ridge Steady Point Rifle Shooting Rest," http://www.midwayusa.com/eproductpage.exe/showproduct?saleitemid=826745&t=11082005, 2005, 5 pages [Internet accessed on Aug. 6, 2008].
MidwayUSA, "Shooting Supplies—Shop Everything for Your Firearm at MidwayUSA," http://www.midwayusa.com/browse/BrowseProducts.aspx?categoryStrin . . . , 15 pages [Internet accessed on Jul. 21, 2008].
MidwayUSA, "Stoney Point Bench Anchor Rifle Shooting Rest," http://www.midwayusa.com/eproductpage.exe/showproduct?saleitemid=347174&t=11082005, 2005, 2 pages [Internet accessed on Aug. 6, 2008].
Milek, B., "Handloading for Hunting" New Products from RCBS, Lee, Accurate Arms, Peterson's Hunting, Mar. 1985, p. 21.
Millett, "BenchMaster Shooting Rests," 1 page, Undated.
MTM Case-Gard, "Gun Maintenance Centers," http://www.mtmcase-gard.com/products/shooting/gunm.html, the date on which the MTM Gun Maintenance Center was first on sale is not known, but is believed to be circa 2004, 2 pages [Internet accessed Oct. 11, 2006].
MTM Case-Gard, "MTM Shoulder-Gard Rifle Rest," Cover Photo for Rest, p. 2, date unknown.
MTM Case-Gard, "Rifle rest and pistol shoot rest, " http://www/mtmcase-gard.com/products/shooting/shoo.html, the date on which the MTM Site-In-Clean was first on sale is not known, but is believed to be circa 2004, 3 pages [Internet accessed on 10/11/20.
Non-Final Office Action; U.S. Appl. No. 10/865,595; Mailed on Jun. 7, 2006, 8 pages.
Non-Final Office Action; U.S. Appl. No. 11/206,430; Mailed on Jun. 23, 2009, 13 pages.
Non-Final Office Action; U.S. Appl. No. 11/206,430; Mailed on Oct. 14, 2010, 18 pages.
Non-Final Office Action; U.S. Appl. No. 11/206,430; Mailed on May 14, 2008, 10 pages.
Non-Final Office Action; U.S. Appl. No. 11/206,430; Mailed on May 21, 2007, 12 pages.
Non-Final Office Action; U.S. Appl. No. 11/271,100; Mailed on Mar. 26, 2008, 9 pages.
Non-Final Office Action; U.S. Appl. No. 11/311,530; Mailed on Feb. 13, 2007, 10 pages.
Non-Final Office Action; U.S. Appl. No. 11/339,863; Mailed on Sep. 23, 2008, 7 pages.
Non-Final Office Action; U.S. Appl. No. 11/418,407; Mailed on Feb. 24, 2009, 9 pages.
Non-Final Office Action; U.S. Appl. No. 11/431,956; Mailed on May 7, 2012, 10 pages.
Non-Final Office Action; U.S. Appl. No. 11/431,956; Mailed on Feb. 9, 2011, 13 pages.
Non-Final Office Action; U.S. Appl. No. 11/431,956; Mailed on Mar. 2, 2009, 16 pages.
Non-Final Office Action; U.S. Appl. No. 11/505,784; Mailed on Oct. 27, 2009, 8 pages.
Non-Final Office Action; U.S. Appl. No. 11/505,784; Mailed on Dec. 26, 2007, 14 pages.
Non-Final Office Action; U.S. Appl. No. 11/507,683; Mailed on Sep. 18, 2008, 8 pages.
Non-Final Office Action; U.S. Appl. No. 11/607,550; Mailed on Jun. 17, 2010, 12 pages.
Non-Final Office Action; U.S. Appl. No. 11/607,550; Mailed on Nov. 23, 2011, 8 pages.
Non-Final Office Action; U.S. Appl. No. 11/607,550; Mailed on Mar. 2, 2009, 11 pages.
Non-Final Office Action; U.S. Appl. No. 11/679,100; Mailed on May 28, 2010, 9 pages.
Non-Final Office Action; U.S. Appl. No. 11/679,100; Mailed on Oct. 16, 2008, 11 pages.
Non-Final Office Action; U.S. Appl. No. 11/679,136; Mailed on Aug. 18, 2008, 6 pages.
Non-Final Office Action; U.S. Appl. No. 11/679,136; Mailed on Aug. 28, 2008, 8 pages.
Non-Final Office Action; U.S. Appl. No. 11/679,169; Mailed on Apr. 28, 2009, 11 pages.
Non-Final Office Action; U.S. Appl. No. 11/679,832; Mailed on Aug. 28, 2009, 9 pages.
Non-Final Office Action; U.S. Appl. No. 11/739,077; Mailed on Oct. 8, 2009, 7 pages.
Non-Final Office Action; U.S. Appl. No. 11/740,908; Mailed on Jan. 29, 2010, 8 pages.
Non-Final Office Action; U.S. Appl. No. 11/746,551; Mailed on Apr. 14, 2010, 8 pages.
Non-Final Office Action; U.S. Appl. No. 11/746,551; Mailed on Jul. 8, 2011, 14 pages.
Non-Final Office Action; U.S. Appl. No. 11/801,341; Mailed on Jan. 13, 2009, 7 pages.
Non-Final Office Action; U.S. Appl. No. 11/844,980; Mailed on Dec. 16, 2010, 9 pages.
Non-Final Office Action; U.S. Appl. No. 11/844,980; Mailed on Aug. 21, 2008, 8 pages.
Non-Final Office Action; U.S. Appl. No. 11/846,408; Mailed on Aug. 18, 2008, 8 pages.
Non-Final Office Action; U.S. Appl. No. 11/853,745; Mailed on Jun. 19, 2009, 11 pages.
Non-Final Office Action; U.S. Appl. No. 11/853,763; Mailed on Dec. 22, 2008, 6 pages.
Non-Final Office Action; U.S. Appl. No. 12/037,336; Mailed on Sep. 15, 2010, 33 pages.
Non-Final Office Action; U.S. Appl. No. 12/117,668; Mailed on Aug. 13, 2009, 15 pages.
Non-Final Office Action; U.S. Appl. No. 12/172,848, Mailed on Nov. 22, 2010, 32 pages.
Non-Final Office Action; U.S. Appl. No. 12/177,032; Mailed on Feb. 23, 2010, 6 pages.
Non-Final Office Action; U.S. Appl. No. 12/177,032; Mailed on Aug. 15, 2011, 9 pages.
Non-Final Office Action; U.S. Appl. No. 12/209,113; Mailed on Sep. 23, 2009, 6 pages.
Non-Final Office Action; U.S. Appl. No. 12/276,223; Mailed on Jul. 19, 2011, 11 pages.
Non-Final Office Action; U.S. Appl. No. 12/276,223; Mailed on Dec. 27, 2010, 37 pages.
Non-Final Office Action; U.S. Appl. No. 12/276,229; Mailed on Aug. 30, 2010, 8 pages.
Non-Final Office Action; U.S. Appl. No. 12/476,041; Mailed on Nov. 18, 2009, 6 pages.
Non-Final Office Action; U.S. Appl. No. 12/614,578; Mailed on Dec. 8, 2011, 12 pages.
Non-Final Office Action; U.S. Appl. No. 12/769,438; Mailed on Jul. 15, 2011, 55 pages.
Non-Final Office Action; U.S. Appl. No. 12/899,418; Mailed on Jan. 3, 2012, 30 pages.
"Offering the best in Fishing, Hunting and Outdoor Products"; Basspro.com, Bass Pro Shops Outdoors Online; http://www.basspro.com/webapp/wcs/stores/servlet/Product__10151__-1__10001__95064__SearchResults, 2 pages[Internet accessed on Aug. 6, 2008].
Plano Shooters Case, Brown Camo, The Sportsman's Guide, http://www.sportmansguide.com/cb/cb.asp?a=148225, the date on which the Plano Shooters Case was first on sale is not known but is believed to be circa 2004, 3 pages [Internet accessed No. 10/11/200.
Precision Shooting, Inc., Bald Eagle Front Rest, The Accurate Rifle, vol. 6, Issue No. 4, May 2003, p. 47.
Protektor Model, "The Original Leather Rifle and Pistol Rest," http://www.protektormodel.com/, 12 pages [Internet accessed on Feb. 14, 2006].
RCBS Automatic Primer Tool, pp. 68-71, undated.
RCBS, "Reloading Equipment," http://www.rcbs.com/default.asp?menu=1&s1=4&s2=3&s3=25, 1 page [Internet accessed Apr. 24, 2007].
Reloading Manual Number Ten for Rifle and Pistol, The Cartridge Components, SPEER Omark Industries, pp. 28-54.
Shooters Ridge, "Deluxe Rifle Rest," http://www.shootersridge.com, 1 page [Internet accessed Jul. 21, 2008].
Shooters Ridge, "Shooting Rest with Gun Vise," http://www.shootersridge.com, 1 page [Internet accessed Jul. 17, 2008].
Shotshell reloading with a GRABBER, MEC—Mayville Engineering Company, Inc., pp. 1-12.
SHTRS RDG Steady PNT Rifle Rest DLX, Grips/Pads/Stocks, Gun Accessories, Hunting & Shooting Accessories, Hunting Gear, Fishing & Hunting, Amazon.com; http://www.amazon.com/STEADY-Accessories-Hunting-Shooting-Fishin . . . , 1 pages [Internet accessed on Jul. 22.
Sinclair International, Sinclair Shooting Rests, Products for the Precision Shooter, 2002, Issue No. 2002-B pp. 76-78.
Stoney Point Adjustable Shooting Rest w/Bag, Sports & Outdoors, Amazon.com; http://www.amazon.com/Stoney-Point-Adjustable-Shooting-Rest/dp/B0, 1 page [Internet accessed on Jul. 22, 2008].
Sweeney, P., "Gunsmithing: Measure Headspace," Peterson's Rifleshooter, http://www.rifleshootermag.com/gunsmithing/headspace_0612/ , 4 pages [Internet accessed Dec. 11, 2004].
Tenex Precision Co., "Recoil A-Rest-R," 4 pages, date unknown [product photos].
The Blue Press, "Dillon Case Preparation Equipment," http://dillonprecision.com/template/p.cfm?maj=16&min=0&dyn=1&, Apr. 2007, 2 pages [Internet accessed Apr. 24, 2007].
The Grabber and Hustler '76, MEC—Mayville Engineering Company, Inc., 2 pgs, date unknown.
Uncle Bud'S Bull Bags, http:www.unclebudscss.com/pages/Bulls%20bags.html, 2 pgs. [Internet accessed on Feb. 14, 2006].
Uncle Bud'S Udder Bag, http:www.unclebudscss.com/pages/Udder%20Bags.html, 2 pgs. [Internet accessed on Feb. 14, 2006].
Basspro.com, "Bass Pro Shops Outdoors Online: Offering the best in Fishing, Hunting and Outdoor Products," http://www.basspro.com/webapp/wcs/stores/servlet/Product_10151_-1_10001_95064_SearchResults, 2 pages [Internet accessed on Aug. 6, 2008].
Final Office Action; U.S. Appl. No. 13/009,660; Mailed on Sep. 26, 2012.
Non-Final Office Action, U.S. Appl. No. 13/095,549; Mailed on Feb. 7, 2012, 13 pgs.
Non-Final Office Action; U.S. Appl. No. 13/344,280; Mailed on Feb. 27, 2012, 9 pages.

* cited by examiner

SHOOTING RESTS WITH ADJUSTABLE HEIGHT FOR SUPPORTING FIREARMS

CROSS-REFERENCE TO RELATED APPLICATION

The present application is a continuation of U.S. application Ser. No. 12/276,229, filed Nov. 21, 2008, the disclosure of which is incorporated herein by reference in its entirety.

TECHNICAL FIELD

The present invention is directed to shooting rests for supporting firearms and, more specifically, to shooting rests having height adjustment assemblies.

BACKGROUND

Shooters often use firearm rests or supports to steady a firearm during target practice, accuracy testing, hunting, etc. Holding a firearm without a stable support may limit the shooter's ability to accurately fire the firearm. When sighting in a rifle, for example, a shooter typically wants to keep the rifle in the same position for different shots. Many shooters accordingly use a support in an attempt to reduce or eliminate human movement inherent in holding the firearm. Some supports are capable of holding the entire firearm. For example, a user can place the forestock of a rifle on a front support and the buttstock of a rifle on a rear support. Other supports may hold only one portion of the firearm. For example, a shooter may hold the buttstock and use a single support for the forestock of the rifle. To provide a desired level of stability, many conventional firearm supports are bulky devices that hold the firearm at a fixed height. Other firearm supports, however, may provide adjustability of the position of the firearm at the front and/or rear support.

DETAILED DESCRIPTION

1. Overview

Figure 1:
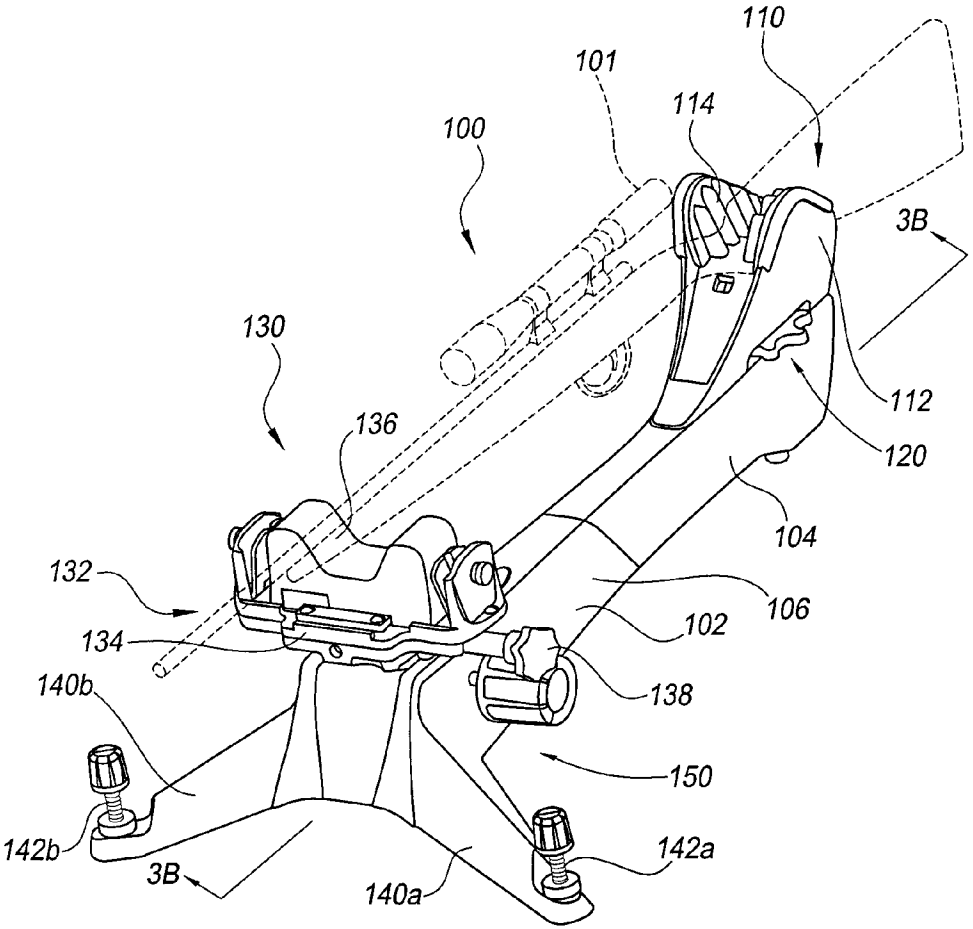
FIG. 1 is a front isometric view of a shooting rest assembly configured in accordance with an embodiment of the disclosure.

The following disclosure describes several embodiments of firearm shooting rest assemblies and associated methods of use and manufacture. One embodiment of the disclosure, for example, is directed to a shooting rest for supporting a firearm having a buttstock spaced apart from a forestock. The shooting rest includes a first base portion carrying a first support for supporting the buttstock, and a second base portion coupled to the first base portion and carrying a second support for supporting the forestock. The second base portion includes a body having an opening extending therethrough, and a height adjustment member slidably positioned in the opening. The height adjustment member has a non-circular cross-sectional shape in a plane that is generally transverse to a longitudinal axis of the height adjustment member. The height adjustment member is attached to the second support and configured to adjust a height of the second support. The second base portion also includes a biasing member contacting the height adjustment member. The biasing member at least partially inhibits movement of the height adjustment member through the opening.

Another aspect of the disclosure is directed to a shooting rest assembly for use with a firearm having a buttstock spaced apart from a forestock. The shooting rest assembly includes a base having a first end portion spaced apart from a second end portion. The first end portion carries a first support and the second end portion carries a second support. The first and second supports receive the forestock and buttstock, respectively. The shooting rest assembly also includes a height adjustment member attached to the second support and slidably received in an opening of the second end portion of the base. The height adjustment member includes a first guide portion spaced apart from a second guide portion. Each of the first and second guide portions extends substantially along a length of the height adjustment member. The shooting rest assembly also includes a biasing member engaged with the height adjustment member. The biasing member exerts an adjustable frictional force against the height adjustment member to at least partially inhibit movement of the height adjustment member through the opening of the second end portion of the base.

A further aspect of the disclosure is directed to a firearm rest assembly for use with a firearm having a buttstock opposite a forestock. The firearm rest assembly includes a base having a first end portion spaced apart from a second end portion. The firearm rest assembly also includes a buttstock support and a forestock support. The first end portion of the base carries the buttstock support, which is configured to receive the firearm buttstock. The second end portion of the base carries the forestock support, which is configured to receive the firearm forestock. The firearm rest assembly further includes a height adjustment assembly coupling the forestock support to the second end portion of the base. The height adjustment assembly includes a height adjustment dial carrying a height adjustment shaft. The height adjustment assembly also includes a height adjustment support movably coupled to the second end portion of the base and attached to the forestock support. The height adjustment support includes first means for aligning the height adjustment support in the second end portion of the base, and second means for engaging the height adjustment shaft to change the elevation of the attached forestock support in response to rotation of the height adjustment dial. The height adjustment assembly also includes a sensitivity adjustment dial and third means for adjusting a sensitivity of the elevation change of the forestock support in response to rotation of the sensitivity adjustment dial.

Specific details of several embodiments of the disclosure are set forth in the following description and in FIGS. 1-6 to provide a thorough understanding of these embodiments. A person skilled in the art will understand, however, that the disclosure may be practiced without several of these details or that additional details can be added to the disclosure. Moreover, several details describing well-known structures or processes often associated with firearms and shooting rest assemblies or devices have not been shown or described in detail to avoid unnecessarily obscuring the description of the embodiments of the disclosure. Where the context permits, singular or plural terms may also include the plural or singular terms, respectively. Moreover, unless the word "or" is expressly limited to mean only a single item exclusive from the other items in reference to a list of two or more items, the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same feature or additional types of features are not precluded.

Reference throughout this specification to "one embodiment" or "an embodiment" means that a particular feature, structure, or characteristic described in connection with the embodiment may be included in at least one embodiment of the present invention. Thus, the phrases "in one embodiment" or "in an embodiment" throughout this specification are not necessarily all referring to the same embodiment. Furthermore, particular features, structures, or characteristics of the different embodiments may be combined in any suitable manner in one or more embodiments.

The headings provided herein are for convenience only and do not interpret the scope or meaning of the claimed invention.

2. Embodiments of Shooting Rests with Adjustable Height Assemblies

FIG. 1 is a front isometric view of a shooting rest assembly 100 ("assembly 100") configured in accordance with an embodiment of the disclosure. The assembly 100 is configured to support a firearm 101 (e.g., a rifle, shotgun, etc.) for shooting, cleaning, etc. The illustrated assembly 100 includes a base 102 having a rear base portion 104 removably attached to a front base portion 106. The rear base portion 104 carries a first or rear support 110 for carrying a rearward section of the firearm 101 (e.g., a buttstock of a rifle), and the front base portion 106 carries a second or front support 130 for carrying a forward section of the firearm 101 (e.g., a forestock of a rifle). As described in detail below, the base 102 allows a user to independently adjust the rear support 110 and the front support 130 to change the position or angle of the firearm 101.

According to one aspect of the illustrated embodiment, the rear support 110 includes a body 112 attached to the rear base portion 104. The body 112 has a generally V-shaped configuration and carries a non-marring member 114 that is sized to receive the rearward section of the firearm 101 to center the firearm 101 and prevent lateral movement of the firearm 101. In the illustrated embodiment, the non-marring member 114 includes multiple gripping features to secure the rearward section of the firearm 101. The non-marring member 114 can be a pliable, rubber-like material to prevent marring of the firearm 101 and provide a slip-resistant contact surface. In other embodiments, the non-marring member 114 can be made from other materials, including, for example, leather. Moreover, in still further embodiments, the body 112 or non-marring member 114 can have other shapes or configurations suitable for supporting the rearward section of a firearm 101. For example, the combination of the body 112 and the non-marring member 114 can form a generally planar surface, a curved surface, etc. As described in more detail below with reference to FIGS. 2-3B, the rear support 110 also includes a rear elevation assembly 120 that is configured to adjust the height or elevation of the rear support 110 and the rear base portion 104, as well as the corresponding rearward section of the firearm 101.

The illustrated front support 130 includes a rest assembly 132 carried by a front elevation assembly 150 that is configured to adjust the height of the forward section of the firearm 101. The rest assembly 132 can include features and components that are generally similar to the rest and support assemblies described in U.S. Patent Application Publication No. US2008/0047189, entitled "Adjustable Shooting Rests and Shooting Rest Assemblies," filed Aug. 22, 2007 (patent application Ser. No. 11/843,641), which is incorporated herein in its entirety by reference. For example, the illustrated rest assembly 132 includes a base 134 carrying a support member 136 having a generally U-shaped configuration that is sized to receive the forward section of the firearm 101. In certain embodiments, the base 134 is configured to removably receive the illustrated support member 136 as well as other support members of different sizes or configurations. The base 134 also includes a lateral adjustment member 138 that is configured to adjust a side-to-side position of the support member 136 with reference to the front base portion 106.

In the illustrated embodiment, the base 102 also includes extensions or arm members 140 (identified individually as a first arm member 140*a* and a second arm member 140*b*) extending laterally from the front base portion 106. Each arm member 140 stabilizes the assembly 100 and also carries an adjustable front foot 142 (identified individually as a first front foot 142*a* and a second front foot 142*b*). Each front foot 142 is independently adjustable to change the elevation of the corresponding arm member 140. For example, each front foot 142 can be adjusted to accommodate uneven or rough terrain.

According to another feature of the illustrated embodiment, the front support 130 includes a front elevation assembly 150 that is configured to adjust the height or elevation of the front support 130. According to several features of the front elevation assembly 150, and as described in detail below with reference to FIGS. 2-6, the front elevation assembly 150 provides rapid height adjustment of the front support 130 along with adjustable sensitivity to allow a user to set the front elevation assembly 150 to the user's own preference. A user can also lock out the front elevation assembly 150 to secure the front support 130 in a specific location.

Figure 2:
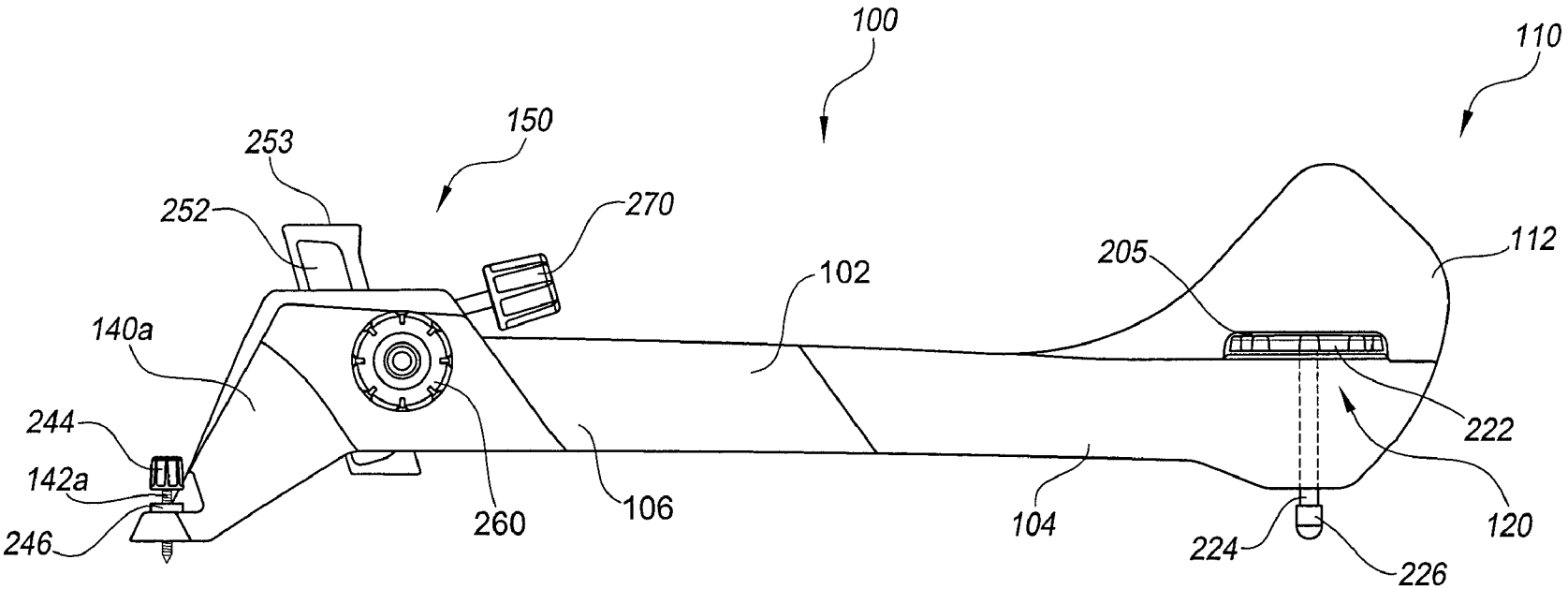
FIG. 2 is a side view of a portion of the shooting rest assembly of FIG. 1.

FIG. 2 is a side view of the assembly 100 with the rest assembly 132 (FIG. 1) removed for purposes of more clearly illustrating certain features of the front elevation assembly 150. For example, as shown in FIG. 2, the front elevation assembly 150 includes a height adjustment member 252 that is operably coupled to a height adjustment dial 260 and a sensitivity adjustment dial 270. According to one feature of the illustrated embodiment, the height adjustment member 252 is positioned in the front base portion 106 in a non-vertical orientation. In other embodiments, however, the height adjustment member 252 can be positioned in a generally vertical orientation. The height adjustment member 252 includes an attachment surface 253 that is configured to be secured to the base 134 of the rest assembly 132 (FIG. 1). As explained in detail below, the height adjustment dial 260 is configured to rapidly adjust the elevational position of the height adjustment member 252 with reference to the front base portion 106, and the sensitivity adjustment dial 270 is configured to adjust the sensitivity of the movement of the height adjustment member 252 as well as lock out the height adjustment member 252 in a specific position.

In addition to the height adjustment member 252, the adjustable front foot 142*a* is also capable of changing the elevation of the front support 130 (FIG. 1). The front foot 142*a*, however, moves the entire front base portion 106, including the first arm member 140*a* and the front elevation assembly 150. More specifically, each front foot 142 includes a gripping portion 244 (e.g., a knurled head) carried by a shaft 246 that threadably engages the corresponding arm member 140. Accordingly, a user can turn the gripping portion 244 to extend or retract the shaft 246 into the arm member 140 to raise or lower the entire front portion 106 of the base 102.

The embodiment illustrated in FIG. 2 also shows the rear elevation assembly 120, which includes a rear elevation dial 222 that is configured to adjust the height of the entire rear base portion 104. The rear base portion 104 carries the rear elevation dial 222 in an opening 205 between the body 112 of the rear support 110 and the rear base portion 104. The rear elevation dial 222 threadably engages a rear adjustment shaft 224 that extends through the bottom of the rear base portion 104. The rear adjustment shaft 224 can also include a rear foot 226. A user can accordingly rotate the rear elevation dial 222 to move the rear adjustment shaft 224 into or out of the rear base portion 104 to move the entire rear base portion 104 up or down.

Figure 3A:
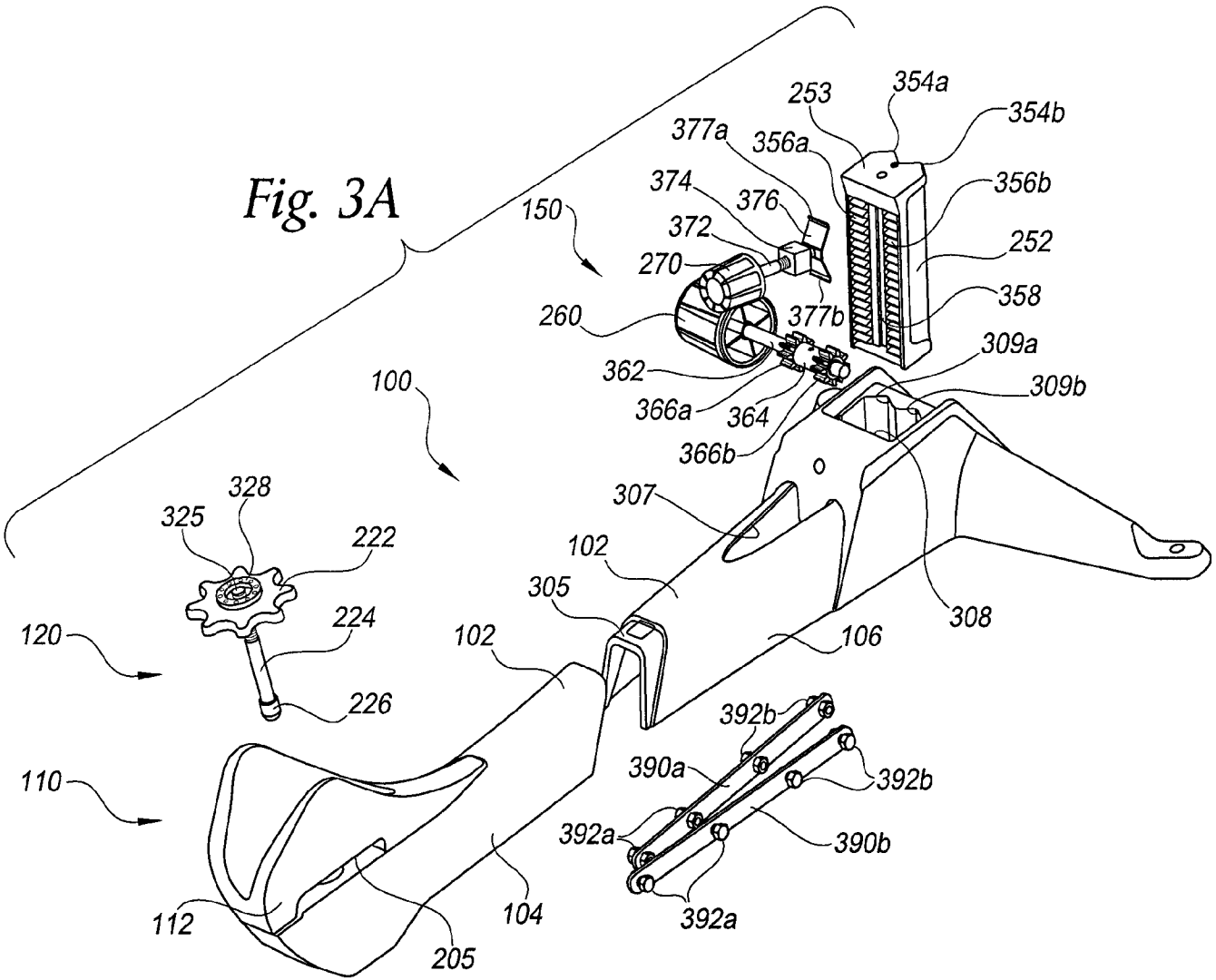
FIG. 3A is an exploded isometric view of the shooting rest assembly of FIG. 2.
Figure 3B:
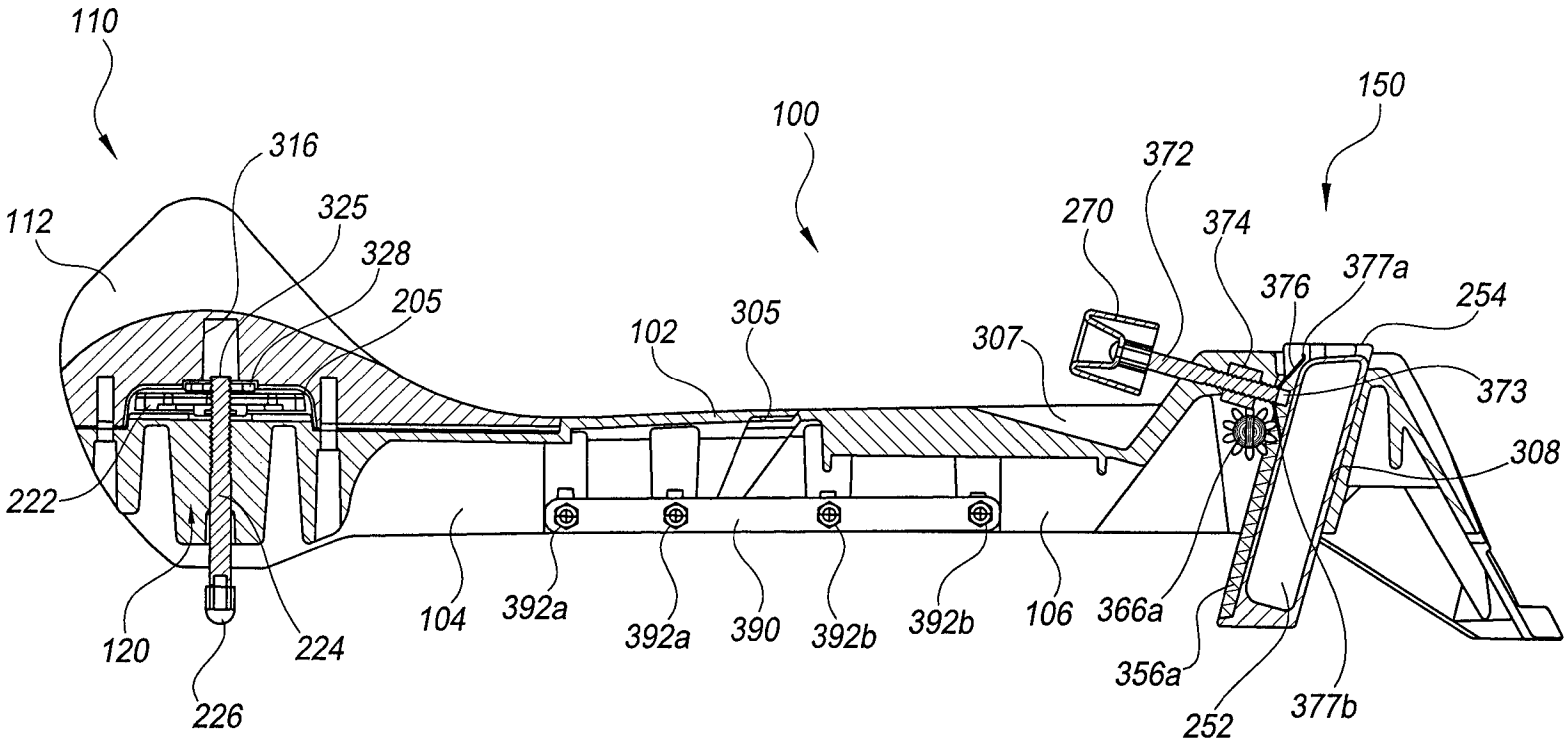
FIG. 3B is a side cross-sectional view of the shooting rest assembly of FIG. 2 taken substantially along the line 3B-3B of FIG. 1.

FIG. 3A is an exploded isometric view of the assembly 100, and FIG. 3B is a side cross-sectional view of the assembly 100 taken substantially along the line 3B-3B of FIG. 1. Referring to FIGS. 3A and 3B together, the exploded and cross-sectional views illustrate several of the features of the front elevation assembly 150 and rear elevation assembly 120. For example, referring to the front elevation assembly 150, the height adjustment member 252 includes a generally non-circular or non-cylindrical shape that fits into a corresponding opening 308 in the body of the front base portion 106. More specifically, the height adjustment member 252 includes guide or alignment protrusions 354 (identified individually as a first alignment protrusion 354*a* and a second alignment protrusion 354*b*) that slide along corresponding alignment portions 309 (identified individually as a first alignment portion 309*a* and a second alignment portion 309*b*) in the opening 308. The shape of the height adjustment member 252, as well as other shapes of height adjustment members, are described in more detail below with reference to FIGS. 4A-5B.

The height adjustment member 252 also includes a planar portion or groove 358 positioned between two spaced-apart flat gear portions or gear racks 356 (identified individually as a first rack 356*a* and a second rack 356*b*). The racks 356 are configured to engage corresponding spaced-apart pinion gears 366 (identified individually as a first pinion gear 366*a* and a second pinion gear 366*b*) that are driven by the height adjustment dial 260. More specifically, a height adjustment pin or shaft 362 extends from the height adjustment dial 260 and carries a sleeve 364 including the pinion gears 366. When a user rotates the height adjustment dial 260, the pinion gears 366 engage the corresponding racks 356 to move the height adjustment member 252 by a rack and pinion gear-type configuration. In this manner, the height adjustment dial 260 moves the height adjustment member 252 through the opening 308 in the front base portion 106. Although the illustrated embodiment includes two pinion gears 366 and two corresponding racks 356 on the height adjustment member 252, in other embodiments the front elevation assembly 150 can include a single pinion gear and corresponding rack. Moreover, in still further embodiments, the pinion gears 366 can be formed directly in the height adjustment shaft 362, without the sleeve 364.

The rack and pinion gear connection between the height adjustment dial 260 and the height adjustment member 252 provides for rapid adjustment of the front support 130 (FIG. 1) carried by the height adjustment member 252. For example, in one embodiment, a single rotation of the height adjustment dial 260 can raise or lower the height adjustment member 252 by at least one inch. In other embodiments, the gearing between the pinion gears 366 and the corresponding racks 356 can be configured to raise or lower the height adjustment member 252 by greater or lesser amounts than one inch.

The front elevation assembly 150 also includes a biasing member 376 that is operably coupled to the sensitivity adjustment dial 270 to allow a user to adjust the sensitivity of the change of height of the front elevation assembly 150. More specifically, the biasing member 376 is captured on an end portion 373 of a sensitivity adjustment pin or shaft 372. The sensitivity adjustment shaft 372 positions the biasing member 376 proximate to the groove 358 in the height adjustment member 252 (FIG. 3B). In the illustrated embodiment, the biasing member 376 is a spring-like member having two legs 377 (identified individually as a first leg 377*a* and a second leg 377*b*) that are aligned with the groove 358 in the height adjustment member 252. The sensitivity adjustment shaft 372 extends from the sensitivity adjustment dial 270 and threadably engages a positioning member 374 that is carried by the front base portion 106. The positioning member 374 is secured in the front base portion 106 to remain generally stationary with reference to the front base portion 106 as the sensitivity adjustment shaft 372 moves through the positioning member 374.

In operation, a user can rotate the sensitivity adjustment dial 270 to adjust a sensitivity of the front elevation assembly 150. More specifically, when a user rotates the sensitivity adjustment dial 270, the sensitivity adjustment shaft 372 rotates through the positioning member 374 to move the biasing member 376 toward or away from the height adjustment member 252. When the sensitivity adjustment shaft 372 moves the biasing member 376 toward the height adjustment member 252, the legs 377 frictionally engage the height adjustment member 252 in the groove 358 to exert a force against the height adjustment member 252. The magnitude of the force exerted by the biasing member 376 against the height adjustment member 252 corresponds to how close the biasing member 376 is positioned next to the height adjustment member 252. In this manner, the front elevation assembly 150 is configured to provide an infinitely variable sensitivity adjustment for a user. The biasing member 376 also helps to at least partially retain the height adjustment member 252 in place after a user sets the biasing member 376 to a desired position because the biasing member 376 can exert a constant contact or frictional force against the height adjustment member 252.

In addition to adjusting the position of the biasing member 376 relative to the height adjustment member 252 to change the sensitivity of the front elevation assembly 150, the end portion 373 of the sensitivity adjustment shaft 372 can also contact the height adjustment member 252 to lock out the front elevation assembly 150. More specifically, a user can rotate the sensitivity adjustment dial 270 to deflect the legs 377 of the biasing member 376 until the end portion 373 of the sensitivity adjustment shaft 372 engages the height adjustment member 252. In this manner, the sensitivity adjustment shaft 372 can contact the height adjustment member 252 to lock or retain the height adjustment member 252 at a desired elevational position.

A further benefit of the illustrated embodiment is that the biasing member 376 can reduce or remove unwanted movement or slack between the height adjustment member 252 and the front base portion 106. For example, the stacked manufacturing tolerances of the height adjustment member 252, the opening 308 in the front base portion 106, the racks 356, the pinion gears 366, etc. may cause the height adjustment member 252 to move or wobble during use. This movement may be undesirable for certain shooting conditions, such as target shooting or sighting in a rifle. The biasing member 376 can at least partially eliminate this unwanted movement, however, by exerting a constant force against the height adjustment member 252 to steady the height adjustment member 252 in the opening 308 in the front base portion 106. Moreover, in certain embodiments, the non-vertical angle of the height adjustment member 252, in combination with the biasing member 376, can also help to remove unwanted movement or wobble from the front elevation assembly 150. For example, the non-vertical angle allows the height adjustment member 252 to rest and slide against the front base portion 106 as the height adjustment member 252 moves through the opening 308.

According to yet another feature of the illustrated embodiment, the height adjustment dial 260 and the sensitivity adjustment dial 270 are each easily accessible to a user. For example, the height adjustment dial 260 extends laterally from the front base portion 106 to allow a user to easily reach and rotate the height adjustment dial 260. Moreover, the front base portion 106 includes a recess 307 proximate to the sensitivity adjustment dial 270 to provide clearance for a user's fingers to rotate the sensitivity adjustment dial 270.

The embodiments shown in FIGS. 3A and 3B also illustrate certain features of the rear elevation assembly 120. For example, the rear adjustment shaft 224 includes a threaded end portion 325 that threadably engages the rear elevation dial 222. The rear elevation assembly 120 also includes a ball-bearing member 328 carried by the rear elevation dial 222. The ball-bearing member 328 is configured to contact an upper surface of the opening 205 to reduce friction between the rear elevation dial 222 and the body 112 of the rear support 110 to allow the rear elevation dial 222 to freely rotate within the opening 205. When a user rotates the rear elevation dial 222, the rear elevation dial 222 moves up or down the threaded end portion 325 of the rear adjustment shaft 224 to adjust the height of the rear support 110. For example, to lower the rear support 110, a user can rotate the rear elevation dial 222 to pull the rear adjustment shaft 224 into the rear support 110. To accommodate the rear adjustment shaft 224, the body 112 of the rear support 110 includes a cavity 316, and the threaded end portion 325 of the rear adjustment shaft 224 can extend into the cavity 316 when the rear support 110 is in a lowered position. In this manner, the rear elevation assembly 120 can move the rear support 110 and the rear base portion 104 together to adjust the rear elevation of the assembly 100.

According to another feature of the illustrated embodiment, the assembly 100 also includes attachment members or bars 390 (identified individually as a first attachment bar 390*a* and a second attachment bar 390*b*) that releasably secure the rear base portion 104 to the front base portion 106. In the exploded view of FIG. 3A, the rear base portion 104 is shown separated from the front base portion 106. In FIG. 3B, the rear base portion 104 is shown secured to the front base portion 106 in an operational configuration. To facilitate the attachment between the base portions, the front base portion 106 includes a shoulder 305 that is inserted into the rear base portion 104 to align the front base portion 106 with the rear base portion 104. Although the front base portion 106 includes the shoulder 305 in the illustrated embodiment, in other embodiments the rear base portion 104 can include a shoulder. Each attachment bar 390 is configured to engage the rear base portion 104 and the front base portion 106 to form the attachment therebetween. More specifically, each attachment bar 390 includes a plurality of first fasteners 392*a* (e.g., bolts, screws, pins, etc.) that are configured to attach to the rear base portion 104, and a plurality of second fasteners 392*b* that are configured to attached to the front base portion 106. As described in more detail below with reference to FIG. 6, the first fasteners 392*a* and the second fasteners 392*b* are releasably received into corresponding slots in the underside of the rear base portion 104 and the front base portion 106.

Figure 4A:
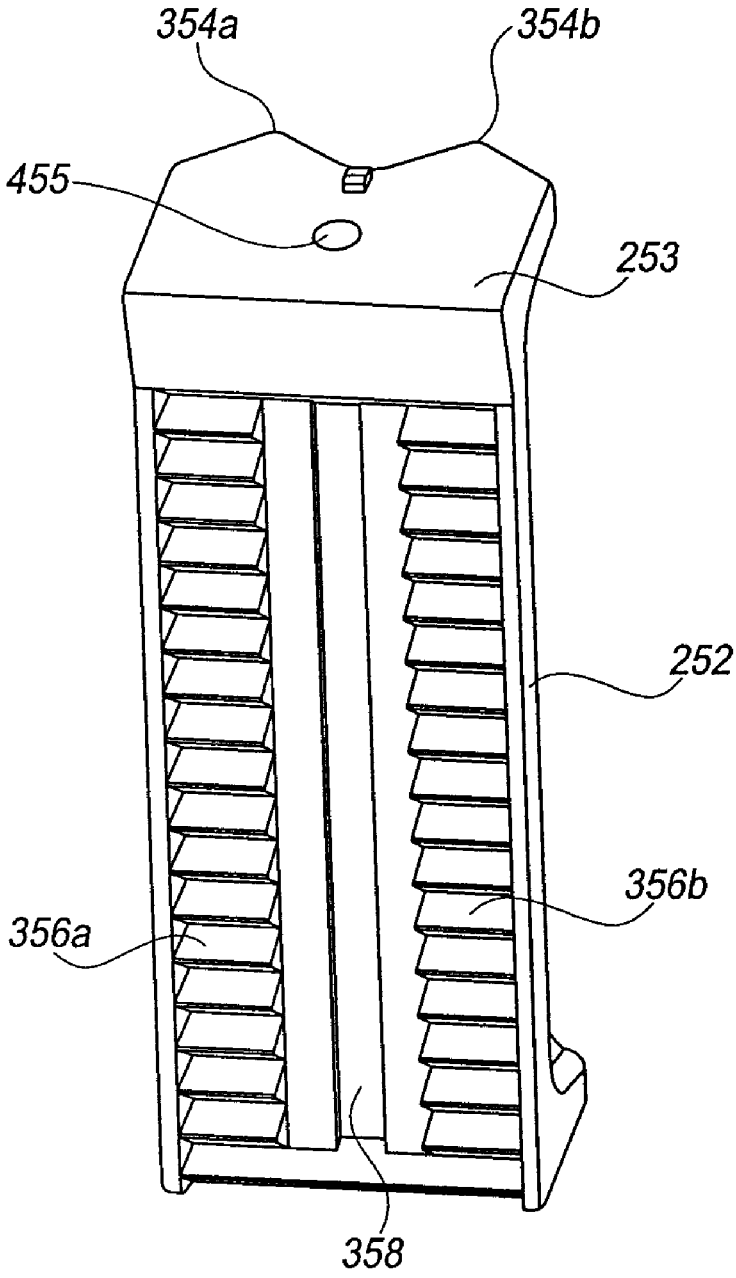
FIG. 4A is a rear isometric view and FIG. 4B is a front isometric view of a height adjustment member configured in accordance with an embodiment of the disclosure.
Figure 4B:
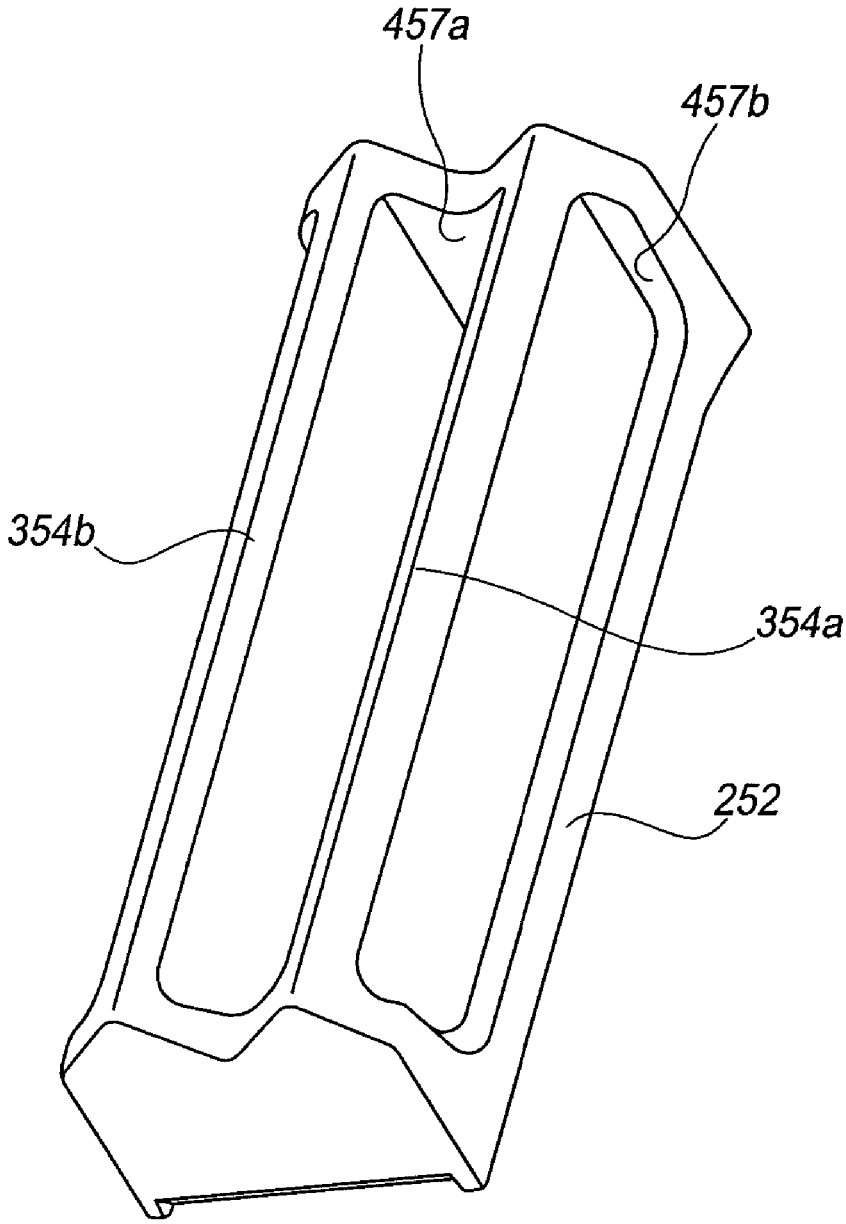

FIG. 4A is a rear isometric view and FIG. 4B is a front isometric view of the height adjustment member 252 configured in accordance with an embodiment of the disclosure. Referring to FIGS. 4A and 4B together, the height adjustment member 252 includes an attachment opening 455 in the attachment surface 253 to connect the front support 130 (FIG. 1). For example, the attachment opening 455 can be a threaded hole that receives a corresponding fastener (e.g., a bolt, screw, etc.) to attach the front support 130 to the attachment surface 253 of the height adjustment member 252. In certain embodiments, the height adjustment member 252, as well as other components, can be formed from a metallic material, synthetic material (e.g., plastic, thermoplastic, thermoset, etc.), or any combination of these or other materials.

As noted above, the illustrated height adjustment member 252 also has a non-circular cross-sectional shape in a plane that is generally transverse to a longitudinal axis of the height adjustment member 252. More specifically, the height adjustment member 252 has a cross-sectional shape that forms a generally M-shaped outer periphery of the height adjustment member 252. For example, the guide or alignment protrusions 354 extend from a distal side of the height adjustment member 252 to help guide the height adjustment member 252 through the front base portion 106. In other embodiments, however, and as described below, the height adjustment member 252 can include other non-circular shapes or configurations, including, for example, a single alignment protrusion. The alignment protrusions 354 of the illustrated embodiment provide the benefit of guiding or aligning the height adjustment member 252 in the opening 308 in the front base portion 106 without the use of any other alignment features or members extending from the front base portion 106.

According to another feature of the illustrated embodiment, the height adjustment member 252 includes a plurality of cavities 457 (identified individually as a first cavity 457*a* and a second cavity 457*b* shown in FIG. 4B) formed in the body of the height adjustment member 252. For example, as seen in FIG. 4B, the first cavity 457*a* extends between the first and second alignment protrusions 354, and the second cavity 457*b* extends proximate to the second alignment protrusion 354*b*. In certain embodiments, the cavities 457 can be created by forming the height adjustment member 252 in a casting or molding manufacturing process. Moreover, the corresponding opening 308 in the front base portion 106 (e.g., FIG. 3A) can also be formed in a casting or molding manufacturing process to correspond to the general shape of the height adjustment member 252. In this manner, these components can be formed as cast or mold complete, without requiring expensive or time-consuming machining processes. Casting or molding these components can also reduce an unfavorable tolerance stack that often results from machining corresponding components.

As noted above, the flat gears or racks 356 (FIG. 4A) can be formed directly in the height adjustment member 252. In certain embodiments, for example, the height adjustment member 252 can be formed in a casting or molding process, such that the racks 356 are formed integrally with the height adjustment member 252. In other embodiments, however, the racks 356 can be formed separately from and attached to the height adjustment member 252.

Moreover, the pitch of the teeth in each rack 356 can be configured, along with the corresponding pinion gear 366, to provide a predetermined length of elevational adjustment per rotation of the height adjustment dial 260 (FIGS. 3A and 3B). For example, one of the benefits of the rack and pinion gear configuration of the front elevation assembly 150 is that the height of the front support 130 (FIG. 1) can be quickly adjusted with relatively few rotations of the height adjustment dial 260. This differs from conventional firearm rest assemblies that use a threaded bushing surrounding a threaded circular shaft to adjust an elevation of a support.

Figure 5A:
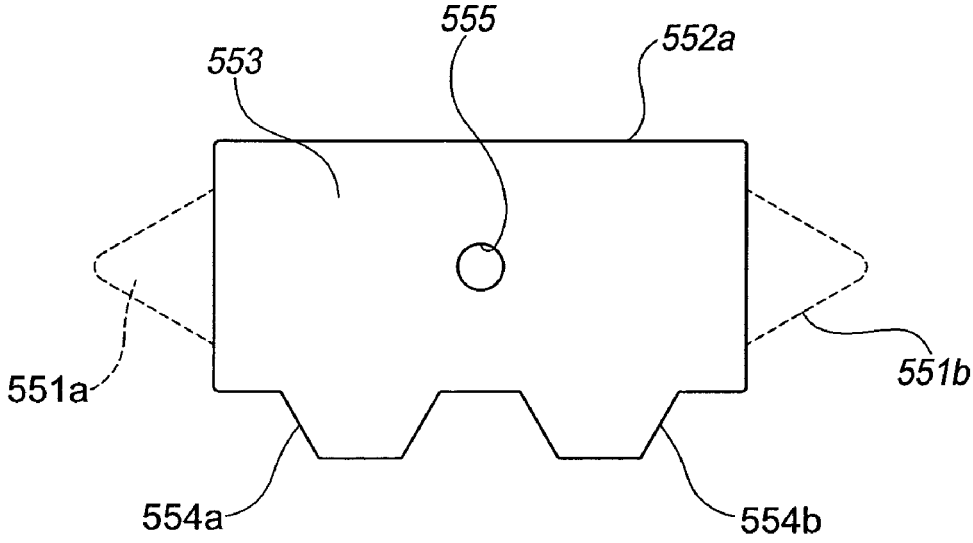
FIGS. 5A and 5B are top views of attachment surfaces of corresponding height adjustment members configured in accordance with embodiments of the disclosure.

FIG. 5A is a top view of an attachment surface 553 of a first height adjustment member 552*a* configured in accordance with another embodiment of the disclosure. The first height adjustment member 552*a* can be generally similar in structure and function to the height adjustment member 252 described above with reference to FIGS. 1-4B. For example, the first height adjustment member 552*a* includes an attachment opening 555 and guide or alignment protrusions 554 (identified individually as a first alignment protrusion 554*a* and a second alignment protrusion 554*b*) extending longitudinally along the first height adjustment member 552*a*. In the illustrated embodiment, however, the alignment protrusions 554 have a generally rectilinear shape forming approximately half of a hexagon (e.g., having three generally planar edges in series at angles of about 120 degrees from each other).

According to another feature of the illustrated embodiment, the first height adjustment member 552*a* also includes lateral alignment protrusions 551 (identified individually as a first lateral alignment protrusion 551*a* and a second lateral alignment protrusion 551*b*) extending from the sides of the first height adjustment member 552*a*. Similar to the alignment protrusions 554, the lateral alignment protrusions 551 can extend along the length of the first height adjustment member 552*a* to orient and align the first height adjustment member 552*a*. For example, an opening that receives the first height adjustment member 552*a* (see, e.g., opening 308 in FIG. 3A) can have a shape with alignment portions that correspond to the shape of the first height adjustment member 552*a* with the alignment protrusions 554 and lateral alignment protrusions 551.

Figure 5B:
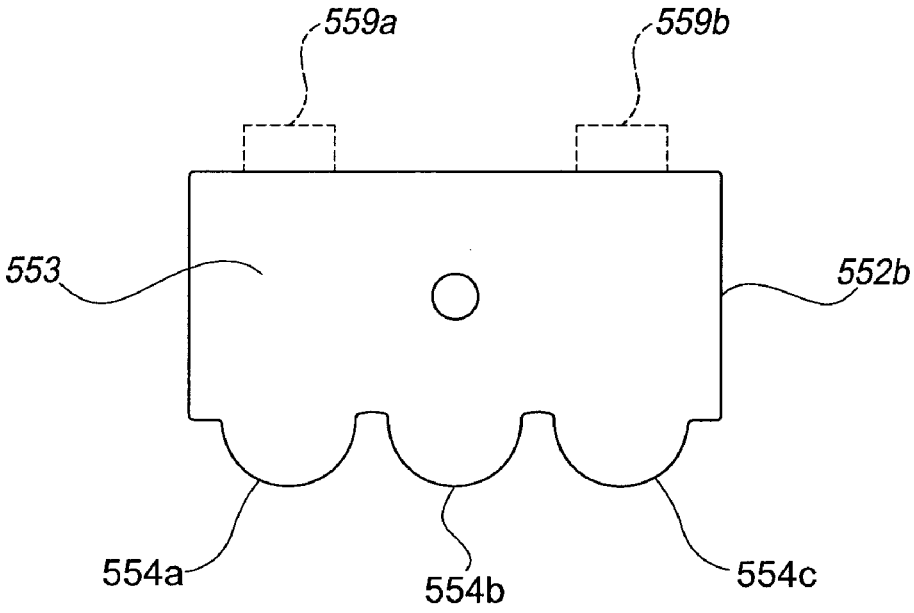

The lateral alignment protrusions 551 illustrated in FIG. 5A have a generally triangular shape. In other embodiments, however, the lateral alignment protrusions 551, as well as other alignment protrusions or alignment features described herein, can include other shapes or configurations. FIG. 5B, for example, is a top view of the attachment surface 553 of a second height adjustment member 552*b* having alignment features with different shapes. For example, the second height adjustment member 552*b* includes semicircular alignment protrusions 554 (identified individually as first-third semicircular alignment protrusions 554*a*-*c*). Moreover, the second height adjustment member 552*b* includes rear alignment protrusions 559 (identified individually as a first rear alignment protrusion 559*a* and a second rear alignment protrusion 559*b*) opposite the semicircular alignment protrusions 554. The illustrated rear alignment protrusions 559 have generally rectangular shapes. In other embodiments, the various alignment protrusions can have other shapes.

Figure 6:
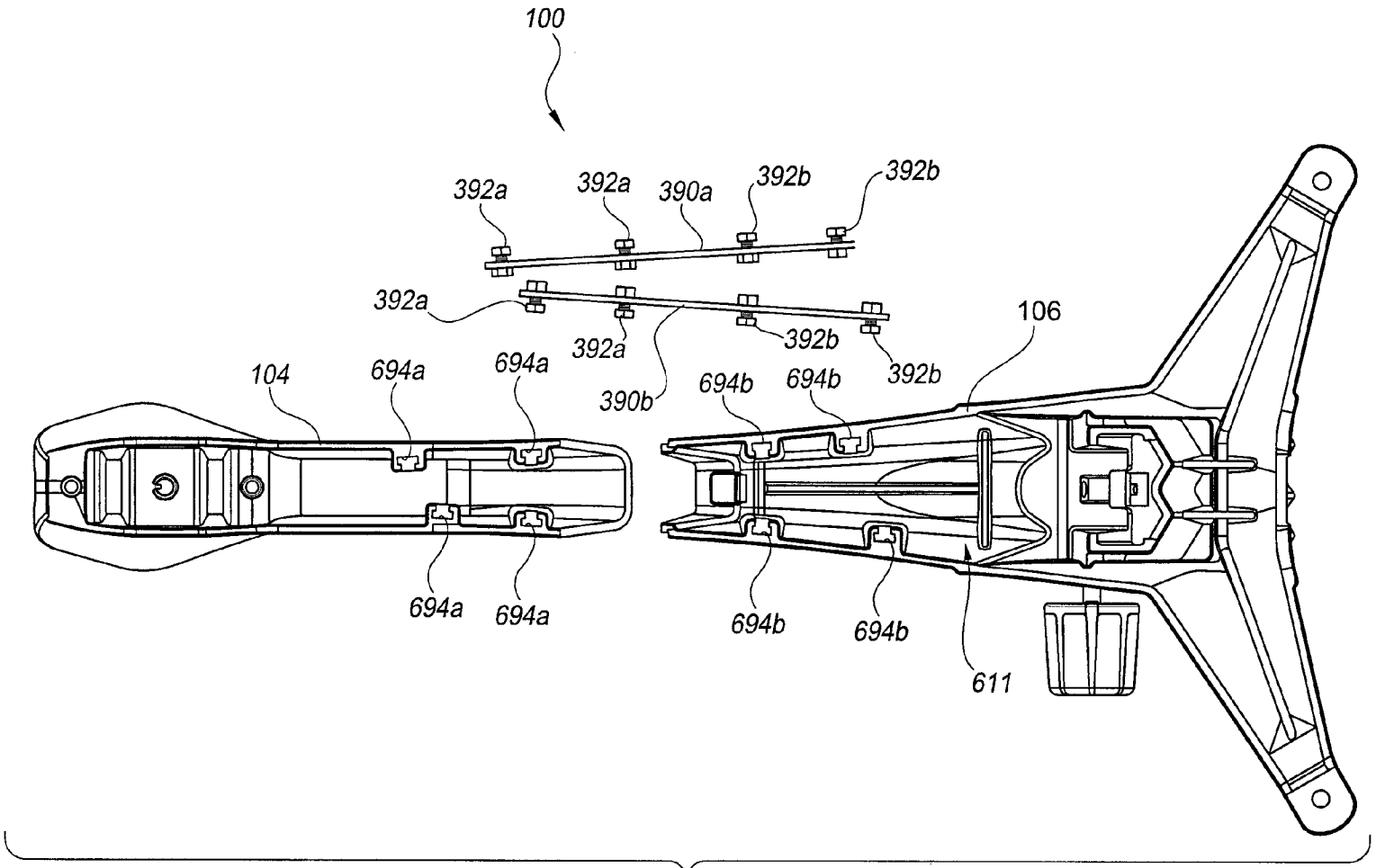
FIG. 6 is a partially exploded bottom view of the shooting rest assembly of FIG. 2.

FIG. 6 is a partially exploded bottom view illustrating an underside 611 of the assembly 100. According to one feature of the illustrated embodiment, the rear base portion 104 and the front base portion 106, as well as the other components and features of the illustrated embodiments, can be formed in a molding (e.g., injection molding, thermoforming, etc.) or casting manufacturing process. For example, the rear base portion 104 and the front base portion 106 can be made from plastic materials to provide a lightweight configuration. Moreover, as shown in the underside 611, the assembly 100 can include a plurality of ribs or stiffeners to provide adequate support in the rear base portion 104 and the front base portion 106 and also allow these components to be formed with a reduced thickness and weight.

According to another aspect of the illustrated embodiment, the rear base portion 104 includes a plurality of first slots 694*a* that are spaced apart from each other and configured to receive the corresponding first fasteners 392*a* carried by the attachment bars 390. The front base portion 106 also includes a plurality of second slots 694*b* that are spaced apart from each other and configured to receive the corresponding second fasteners 392*b*. In this manner, the attachment bars 390 can secure the rear base portion 104 to the front base portion 106. More specifically, the attachment bars 390 can be positioned inside the underside 611 so that the first slots 694*a* receive the first fasteners 392*a*, and the second slots 694*b* receive the second fasteners 392*b*. In certain embodiments, a user can tighten the first fasteners 392*a* and the second fasteners 392*b* to fasten the base portions together. In other embodiments, however, the attachment bars 390 and corresponding first and second fasteners 392*a*, 392*b* can slide in and out of the first slots 694*a* and second slots 694*b*.

From the foregoing, it will be appreciated that specific embodiments of the disclosure have been described herein for purposes of illustration, but that various modifications can be made without deviating from the spirit and scope of the disclosure. For example, the elevation assemblies described herein may have other configurations or include other suitable elevation assembly mechanisms (e.g., multiple height adjustment members, height adjustment members having different shapes, etc.). In addition, a single front support that is not coupled to a rear support can include a height adjustment assembly with sensitivity adjustments, or a rear support can include a height adjustment assembly with sensitivity adjustments as described herein. Moreover, specific elements of any of the foregoing embodiments can be combined or substituted for elements in other embodiments. Furthermore, while advantages associated with certain embodiments of the disclosure have been described in the context of these embodiments, other embodiments may also exhibit such advantages, and not all embodiments need necessarily exhibit such advantages to fall within the scope of the invention. Accordingly, embodiments of the disclosure are not limited except as by the appended claims.

We claim:

1. A method of manufacturing a shooting rest for supporting a firearm having a buttstock spaced apart from a forestock, the method comprising:

coupling a first base portion to a second base portion, the first base portion having a first support configured to receive the buttstock and the second base portion having a body with an opening extending therethrough;

positioning a height adjustment member in the opening, the height adjustment member having a non-circular cross-sectional shape in a plane generally transverse to a longitudinal axis of the height adjustment member, wherein the height adjustment member is configured to carry a second support for receiving the forestock; and coupling a biasing member to the second base portion, wherein the biasing member is configured to slidably contact an exterior surface of the height adjustment member to at least partially inhibit movement of the height adjustment member.

2. The method of claim 1 wherein positioning the height adjustment member in the opening comprises positioning the height adjustment member in an opening having a non-circular shape generally corresponding to the shape of the height adjustment member.

3. The method of claim 1 wherein positioning the height adjustment member in the opening comprises positioning a height adjustment member having a first protrusion spaced apart from a second protrusion, wherein each of the first and second protrusions extends along a length of the height adjustment member.

4. The method of claim 1 wherein coupling the biasing member to the second base portion comprises frictionally engaging the height adjustment member with the biasing member, wherein the frictional engagement provides an adjustable sensitivity to an adjustment of the position of the height adjustment member in the opening.

5. The method of claim 1 wherein positioning the height adjustment member in the opening comprises positioning the height adjustment member in the second base portion at a generally non-vertical angle.

6. The method of claim 1 wherein positioning the height adjustment member in the opening comprises positioning a height adjustment member having a first rack gear spaced apart from a second rack gear, wherein the first and second rack gears extend substantially along a length of the height adjustment member.

7. The method of claim 6 wherein coupling the biasing member to the second base portion comprises frictionally engaging the height adjustment member with the biasing member between the first and second rack gears as the height adjustment member moves within the opening.

8. The method of claim 6, further comprising coupling a shaft of a height adjustment dial the body of the second base portion, wherein the shaft carries a first pinion gear spaced apart from a second pinion gear, and wherein the first pinion gear is configured to engage the first rack gear and the second pinion gear is configured to engage the second rack gear.

9. The method of claim 1 wherein coupling the biasing member to the second base portion further comprises frictionally engaging the biasing member with the height adjustment member to at least partially inhibit movement of the height adjustment member through the opening.

10. A method of manufacturing a shooting rest assembly for use with a firearm having a buttstock spaced apart from a forestock, the method comprising:

coupling a first base end portion to a second base end portion, wherein the first base end portion carries a first support configured to receive the buttstock and the second base end portion includes a body having an opening extending therethrough;

positioning a height adjustment member in the opening of the body, wherein the height adjustment member includes a first guide portion spaced apart from a second guide portion, each of the first and second guide portions extending substantially along a length of the height adjustment member; and coupling a biasing member to the second base end portion, wherein the biasing member is configured to slidably contact an exterior surface of the height adjustment member to at least partially inhibit movement of the height adjustment member through the opening.

11. The method of claim 10, further comprising coupling a sensitivity adjustment shaft of a sensitivity adjustment dial to the second base end portion, wherein the sensitivity adjustment shaft carries the biasing member and moves the biasing member toward or away from the height adjustment member in response to rotation of the sensitivity adjustment dial.

12. The method of claim 10 wherein positioning the height adjustment member in the opening comprises positioning a height adjustment member having a first rack gear spaced apart from a second rack gear, wherein each of the first and second rack gears extends longitudinally along the height adjustment member, and wherein the height adjustment member further includes an at least generally planar portion extending along the height adjustment member between the first and second rack gears, and wherein the biasing member is configured to slide along the at least generally planar portion.

13. The method of claim 10 wherein coupling the biasing member to the second base end portion comprises contacting the height adjustment member with the biasing member along a groove in the height adjustment member, wherein the groove is a generally planar portion of the height adjustment portion.

14. The method of claim 10 wherein coupling the biasing member to the second base end portion comprises coupling a spring to the second base end portion, the spring having a first leg extending away from a second leg, wherein the first and second legs have a generally U-shaped configuration.

15. The method of claim 10 wherein coupling the first base end portion to the second base end portion comprises removably attaching the first base end portion to the second base end portion.

16. A method of manufacturing a shooting rest assembly for use with a firearm having a buttstock spaced apart from a forestock, the method comprising:

coupling a buttstock support to a first end portion of a base, wherein the buttstock support is configured to receive the buttstock;

coupling a forestock support to a second end portion of the base with a height adjustment assembly, wherein the forestock support is configured to receive the forestock, and wherein the height adjustment assembly comprises a height adjustment dial carrying a height adjustment shaft;

a height adjustment member movably coupled to the second end portion of the base and attached to the forestock support, wherein the height adjustment member includes means for aligning the height adjustment member in the second end portion of the base, and means for engaging the height adjustment shaft to change the elevation of the attached forestock support in response to rotation of the height adjustment dial;

a sensitivity adjustment dial;

means for adjusting a sensitivity of the elevation change of the forestock support in response to rotation of the sensitivity adjustment dial; and a biasing member slidably contacting an exterior surface of the height adjustment member, wherein the biasing member at least partially inhibits movement of the height adjustment member through the opening.

17. The method of claim 16 wherein the means for aligning includes:

a first protrusion spaced apart from a second protrusion, each of which projects from the height adjustment member and extends longitudinally along the height adjustment member; and an opening in the second end portion of the base, wherein the opening receives the height adjustment member and includes a first groove corresponding to the first protrusion and a second groove corresponding to the second protrusion.

18. The method of claim 16 wherein the means for engaging includes:

a first rack gear spaced apart from a second rack gear on the height adjustment member;

an elevation adjustment dial; and a shaft extending from the elevation adjustment dial, wherein the shaft carries a first pinion gear spaced apart from a second pinion gear, wherein the first and second pinion gears mesh with the first and second rack gears, respectively, to adjust the elevation of the forestock support in response to rotation of the elevation adjustment dial.

19. The method of claim 16 wherein the means for adjusting includes:

a pin extending from the sensitivity adjustment dial, the pin having a threaded end portion; and wherein the biasing member is carried by the threaded end portion of the pin, wherein rotation of the sensitivity adjustment dial rotates the pin to move the biasing member toward or away from the height adjustment member to engage or disengage the biasing member with the height adjustment member to adjust the sensitivity of the elevation change of the height adjustment member.

20. The method of claim 16 further comprising removably attaching the first end portion of the base to the second end portion of the base.

* * * * *